US009839090B2

(12) United States Patent
Chen et al.

(10) Patent No.: US 9,839,090 B2
(45) Date of Patent: Dec. 5, 2017

(54) CORRELATED COLOUR TEMPERATURE CONTROL SYSTEM AND METHOD

(71) Applicant: THE UNIVERSITY OF HONG KONG, Hong Kong (CN)

(72) Inventors: Huan Ting Chen, Hong Kong (CN); Siew Chong Tan, Hong Kong (CN); Shu Yuen Ron Hui, Hong Kong (CN)

( * ) Notice: Subject to any disclaimer, the term of this patent is extended or adjusted under 35 U.S.C. 154(b) by 0 days.

(21) Appl. No.: 15/314,089

(22) PCT Filed: May 27, 2014

(86) PCT No.: PCT/CN2014/078552
§ 371 (c)(1),
(2) Date: Nov. 27, 2016

(87) PCT Pub. No.: WO2015/180041
PCT Pub. Date: Dec. 3, 2015

(65) Prior Publication Data

US 2017/0202071 A1 Jul. 13, 2017

(51) Int. Cl.
*H01J 7/24* (2006.01)
*H05B 33/08* (2006.01)
(Continued)

(52) U.S. Cl.
CPC ..... *H05B 33/0863* (2013.01); *H05B 33/0845* (2013.01); *F21V 29/70* (2015.01); *F21Y 2115/10* (2016.08)

(58) Field of Classification Search
CPC ..... H01J 61/52; H01J 65/044; H01J 61/523; H01J 13/32; F21K 9/00; F21V 29/004;
(Continued)

(56) References Cited

U.S. PATENT DOCUMENTS 8,159,125 B2 4/2012 Miao
2007/0182347 A1* 8/2007 Shteynberg ..... H05B 33/0815 315/312
2012/0146505 A1* 6/2012 Jonsson ..... H05B 33/0857 315/50

FOREIGN PATENT DOCUMENTS

CN 101697654 A 4/2010
CN 102313249 A 1/2012
CN 103375724 A 10/2013

OTHER PUBLICATIONS

Chen, Huan Ting et al., Dynamic Prediction of Correlated Color Temperature and Color Rendering Index of Phosphor-coated White Light-Emitting Diodes, IEEE Transactions on Industrial Electronics, Feb. 28, 2014, pp. 784-797, No. 2, vol. 61, ISSN:0278-0046.
(Continued)

*Primary Examiner* — Minh D A

(57) ABSTRACT

A correlated color temperature control system (1) for a LED lighting system (2) having at least two LED sources (3, 4) with different correlated color temperatures. The LED lighting system (2) has a combined correlated color temperature resulting from the combination of the different correlated color temperatures of the at least two LED sources (3, 4), and a combined luminous flux resulting from the combination of the luminous fluxes of the at least two LED sources (3, 4), with each LED source being supplied with a supply current. The correlated color temperature control system (1) comprises a controller (5) to independently control one or both of the duty cycle and amplitude of each supply current, the duty cycle or amplitude of each supply current being varied by the controller in a non-linear relationship with the duty cycle or amplitude of at least one other of the supply currents, to generate a desired combined correlated color temperature for the LED lighting system (2) at a desired
(Continued)

combined luminous flux for the LED lighting system (3, 4). An associated method is also provided.

20 Claims, 13 Drawing Sheets

(51) Int. Cl.
*F21V 29/70* (2015.01)
*F21Y 115/10* (2016.01)

(58) Field of Classification Search
CPC .... H05B 41/36; H05B 41/00; H05B 33/0815; H05B 33/0818; H05B 41/2828; H05B 41/3921; H05B 41/3927
See application file for complete search history.

(56) References Cited

OTHER PUBLICATIONS

State Intellectual Property Office of the People's Republic of China (SIPO), International Search Report (ISR), dated Mar. 3, 2015, pp. 1-6, SIPO.

* cited by examiner

CORRELATED COLOUR TEMPERATURE CONTROL SYSTEM AND METHOD

FIELD OF THE INVENTION

The present invention relates to correlated colour temperature (CCT) control system for LED lighting systems and methods of controlling the correlated colour temperature of LED lighting systems, and in particular, LED lighting systems comprising two or more LED sources with different correlated colour temperatures.

BACKGROUND OF THE INVENTION

The luminous intensity (brightness) of a lamp made up of multiple LEDs is the result of the total luminous flux emitted from all the LEDs. To perform smooth and continuous brightness control of the lamp, the luminous flux emitted by the individual LED has to be adjusted. The adjustment of luminous flux of each LED can be achieved either by changing the amplitude level or the duty-cycle pulse, or by concurrently changing both the amplitude level and the duty-cycle pulse of the currents flowing through the LED.

Lamps that have adjustable CCT of wide ranges are highly valued products in the electric lighting market. Lamps with such a feature typically allow the continuous change of the CCT from a low value, e.g. 2000K (warm white) to a high value, e.g. 5000K (cold white). To achieve this, the lamp must comprise light sources with at least two distinct CCT values. In the case of LED lamps, an array of LEDs with low CCT (e.g. 2000K) and an array of LEDs with high CCT (e.g. 5000K) may be adopted in the product. If light of 2000K is required, only LEDs with CCT of 2000K are turned on. If light of 5000K is required, only LEDs with CCT of 5000K are turned on. For light of CCT between 2000K and 5000K, both arrays of LEDs are turned on and driven such that the overall combined light emitted from the lamp is of the required CCT value.

For example, in the method proposed by Miao (U.S. Pat. No. 8,159,125 B2 April 2012) [2], light from the two arrays of LEDs are mixed to give a desired CCT by controlling the proportion of the emitted light of each respective array. For this approach, the control of the CCT of the overall light is based on the formula:

$$CCT_{light}=CCT_{low}*W+CCT_{high}*(1-W), \quad \text{(Equation 1)}$$

where $CCT_{low}$ is the CCT value of the LEDs with the lower CCT, $CCT_{high}$ is the CCT value of the LEDs with the higher CCT, and W is the weightage factor that allows the adjustment of the CCT. Here, W is bounded between 0 and 1 such that $0<W<1$.

In the method proposed by Jonsson (20120146505) [3], the two arrays of LEDs are placed in anti-parallel manner such the anode of one LED array is connected to the cathode of the other LED array and vice versa. Current flowing in one direction turns on the first LED array and current flowing in the opposite direction turns on the second LED array. The driving actions are alternatively repeated. A controller manages the control of the CCT by adjusting the duty cycle D of an alternating current flowing through the two LEDs to control the color temperature and/or the brightness of the lighting apparatus. The control of the CCT of the light using such an approach can be mathematically expressed as:

$$CCT_{light}=CCT_{low}*D+CCT_{high}*(1-D), \quad \text{(Equation 2)}$$

where $0<D<1$.

In practice, however, the correlated color temperature (CCT) of the emitted flux of the LED changes with many factors, including the junction temperature of the respective LED and the amplitude of the current flowing through the LED. Therefore, with the prior approaches for adjusting brightness, there will always be an undesired change on the CCT of the luminous flux of the LEDs in the process of adjusting brightness. The change in CCT during the brightness adjustment process may or may not be significant. A ±200 K deviation in CCT within the desired CCT value is often cited as an acceptable error in electric lamps. Table 1 gives the requirement set in the ANSI Standard C78.377 [1].

TABLE 1

Nominal CCT Categories (extracted from [40])

| Nominal CCT | Target CCT and Tolerance (K) |
|---|---|
| 2700 K | 2725 ± 145 |
| 3000 K | 3045 ± 175 |
| 3500 K | 3465 ± 245 |
| 4000 K | 3985 ± 275 |
| 4500 K | 4503 ± 243 |
| 5000 K | 5028 ± 283 |
| 5700 K | 5665 ± 355 |
| 6500 K | 6530 ± 510 |

As described above, the CCT control approaches by Miao (U.S. Pat. No. 8,159,125 B2 April 2012) [2] and Jonsson (20120146505) [3] are based on simple linear relationships between the CCT of the component arrays of LEDs. As a result, the overall CCT control achievable with these approaches (hereinafter termed "linear approaches") is highly inaccurate. The errors introduced by such prior approaches are significant especially if wide-range dimming and CCT control are required. FIG. 1 is a graph that shows the errors associated with prior approaches to controlling overall CCT of an LED lighting system comprising LEDs having two different CCTs. It is evident from FIG. 1 that there is deviation between the desired Ca control using linear approaches and the actual experimental CCT of the LED lighting system. The error is particularly significant at the higher desired. CCT level of 4000 K.

It is an object of the present invention to overcome or ameliorate at least one of the disadvantages of the prior art, or to provide a useful alternative.

SUMMARY OF THE INVENTION

The present invention, in a first aspect, provides a correlated colour temperature control system for a LED lighting system having at least two LED sources with different correlated colour temperatures, the LED lighting system having a combined correlated colour temperature resulting from the combination of the different correlated colour temperatures of the at least two LED sources, the LED lighting system having a combined luminous flux resulting from the combination of the luminous fluxes of the at least two LED sources, each LED source being supplied with a supply current, the correlated colour temperature control system comprising a controller to independently control one or both of the duty cycle and amplitude of each supply current, the duty cycle or amplitude of each supply current being varied by the controller in a non-linear relationship with the duty cycle or amplitude of at least one other of the supply currents, to generate a desired combined correlated colour temperature for the LED lighting system at a desired combined luminous flux for the LED lighting system.

In one embodiment, the non-linear relationship takes into account thermal effects of each LED on the combined correlated colour temperature of the LED lighting system.

In one embodiment, the non-linear relationship takes into account one or more of the following characteristics of one or more of the LED sources: the correlated colour temperature, luminous flux, junction temperature, and the thermal effect of the other LED sources.

In one embodiment, the LED sources are mounted on one or more heatsinks, and the non-linear relationship takes into account a thermal resistance of one or more of the heatsinks.

In one embodiment, the non-linear relationship is defined by the following equation:

$$CCT_M = \frac{\phi_1 + \ldots + \phi_n}{\frac{\phi_1}{CCT_1} + \ldots + \frac{\phi_n}{CCT_n}}$$

in which:

$CCT_M$ is the combined correlated colour temperature of the LED lighting system;

$CCT_i$ is the correlated colour temperature of the 1st LED source;

$CCT_n$ is the correlated colour temperature of the nth LED source;

$\phi_1$ is the averaged luminous flux of the 1st LED source; and $\phi_n$ is the averaged luminous flux of the nth LED source.

In one embodiment, the LED lighting system has a warm-white LED source and a cool-white LED source, and the non-linear relationship is defined by the following equation:

$$CCT_M = \frac{\phi_W + \phi_C}{\frac{\phi_W}{CCT_W} + \frac{\phi_C}{CCT_C}}$$

in which:

$CCT_M$ is the combined correlated colour temperature of the LED lighting system;

$CCT_W$ is the correlated colour temperature of the warm-white LED source;

$CCT_C$ is the correlated colour temperature of the cool-white LED source:

$\phi_W$ is the averaged luminous flux of the warm-white LED source; and $\phi_C$ is the averaged luminous flux of the cool-white LED source.

In one embodiment, the averaged luminous flux of one or more of the LED sources is a function of a duty cycle ratio of the respective LED source.

In one embodiment, the averaged luminous flux of one or more of the LED sources is a function of one or more constant parameters. In one embodiment, the one or more constant parameters are derived from measurement.

In one embodiment, the correlated colour temperature of one or more of the LED sources is a function of a total duty cycle ratio of the respective LED source.

In one embodiment, the correlated colour temperature of one or more of the LED sources is a function of a minimum correlated colour temperature and a maximum correlated colour temperature of the respective LED source, the minimum and maximum correlated colour temperatures being functions of the total duty cycle ratio of the respective LED source.

In one embodiment, the correlated colour temperature of one or more of the LED sources is a polynomial function of a total duty cycle ratio of the respective LED source.

In one embodiment, the controller comprises a numerical solver to determine in accordance with the non-linear relationship the duty cycle or amplitude of each supply current required to provide the desired combined correlated colour temperature at the desired combined luminous flux.

In one embodiment, the duty cycles or amplitudes of each supply current required in accordance with the non-linear relationship to provide respective combined correlated colour temperatures and combined luminous fluxes are contained in a look-up table, and the controller selects from the look-up table the duty cycle or amplitude of each supply current required to provide the desired combined correlated colour temperature at the desired combined luminous flux.

In one embodiment, the amplitude of each supply current is fixed.

In one embodiment, the controller generates an individual pulse width modulation signal for each supply current.

In one embodiment, the correlated colour temperature control system comprises a MOSFET driver for each supply current, the MOSFET driver receiving the pulse width modulation signal and modulating the supply current in accordance with the pulse width modulation signal. In one embodiment, each MOSFET driver comprises MOSFET switches to modulate the supply current.

In one embodiment, the correlated colour temperature control system comprises a combined correlated colour temperature setting module for receiving a user-defined combined correlated colour temperature for the LED lighting system from a user and setting the desired combined correlated colour temperature based on the user-defined combined correlated colour temperature. In one embodiment, if the user-defined combined correlated colour temperature is above a maximum combined correlated colour temperature for the LED lighting system then the desired combined correlated colour temperature is set to equal the maximum combined correlated colour temperature; if the user-defined combined correlated colour temperature is below a minimum combined correlated colour temperature for the LED lighting system then the desired combined correlated colour temperature is set to equal the minimum combined correlated colour temperature; and if the user-defined combined correlated colour temperature is less than or equal to the maximum combined correlated colour temperature, or is greater than or equal to the minimum combined correlated colour temperature, then the desired combined correlated colour temperature is set to equal the user-defined combined correlated colour temperature.

In one embodiment, the correlated colour temperature control system comprises a light sensor to measure the combined correlated colour temperature, and if the difference between the combined correlated colour temperature and the desired combined correlated colour temperature is larger than a predetermined correlated colour temperature tolerance then the controller varies the duty cycle or amplitude of one or more supply currents such that the difference between the combined correlated colour temperature and the desired combined correlated colour temperature is less than or equal to the predetermined correlated colour temperature tolerance.

In one embodiment, the correlated colour temperature control system comprises a combined luminous flux setting module for receiving a user-defined combined luminous flux for the LED lighting system from a user and setting the desired combined luminous flux for the LED lighting system. In one embodiment, if the user-defined combined luminous flux is above a maximum combined luminous flux for the LED lighting system then the desired combined luminous flux is set to equal the maximum combined luminous flux; if the user-defined combined luminous flux is below a minimum combined luminous flux for the LED lighting system then the desired combined luminous flux is set to equal the minimum combined luminous flux; and if the user-defined combined luminous flux is less than or equal to the maximum combined luminous flux, or is greater than or equal to the minimum combined luminous flux, then the desired combined luminous flux is set to equal the user-defined combined luminous flux.

In one embodiment, the correlated colour temperature control system comprises a temperature sensor to measure a junction temperature of the LED sources, and if the junction temperature is above a maximum rated junction temperature of the LED sources then the desired combined luminous flux is reduced.

In one embodiment, the correlated colour temperature control system comprises a photometric sensor to measure the combined luminous flux, and if the difference between the combined luminous flux and the desired combined luminous flux is larger than a predetermined luminous flux tolerance then the controller varies the duty cycle or amplitude of one or more supply currents such that the difference between the combined luminous flux and the desired combined luminous flux is less than or equal to the predetermined luminous flux tolerance.

In a second aspect, the present invention provides a method of controlling a correlated colour temperature of a LED lighting system having at least two LED sources with different correlated colour temperatures, the LED lighting system having a combined correlated colour temperature resulting from the combination of the different correlated colour temperatures of the at least two LED sources, the LED lighting system having a combined luminous flux resulting from the combination of the luminous fluxes of the at least two LED sources, each LED source being supplied with a supply current, the method comprising independently controlling one or both of the duty cycle and amplitude of each supply current by varying the duty cycle or amplitude of each supply current in a non-linear relationship with the duty cycle or amplitude of at least one other of the supply currents to generate a desired combined correlated colour temperature for the LED lighting system at a desired combined luminous flux for the LED lighting system.

In one embodiment, the method comprises taking into account thermal effects of each LED on the combined correlated colour temperature of the LED lighting system when varying the duty cycle or amplitude of each supply current.

In one embodiment, the method comprises taking into account one or more of the following characteristics of one or more of the LED sources: the correlated colour temperature, luminous flux, junction temperature, and the thermal effect of the other LED sources, when varying the duty cycle or amplitude of each supply current.

In one embodiment, the LED sources are mounted on one or more heatsinks, and the method comprises taking into account a thermal resistance of one or more of the heatsinks when varying the duty cycle or amplitude of each supply current.

In one embodiment, the method comprises calculating the non-linear relationship with the following equation:

$$CCT_M = \frac{\phi_1 + \ldots + \phi_n}{\frac{\phi_1}{CCT_1} + \ldots + \frac{\phi_n}{CCT_n}}$$

in which:

$CCT_M$ is the combined correlated colour temperature of the LED lighting system;

$CCT_1$ is the correlated colour temperature of the 1st LED source;

$CCT_n$ is the correlated colour temperature of the nth LED source;

$\phi_1$ is the averaged luminous flux of the 1st LED source; and $\phi_n$ is the averaged luminous flux of the nth LED source.

In one embodiment, the LED lighting system has a warm-white LED source and a cool-white LED source, and the method comprises calculating, the non-linear relationship with the following equation:

$$CCT_M = \frac{\phi_W + \phi_C}{\frac{\phi_W}{CCT_W} + \frac{\phi_C}{CCT_C}}$$

in which:

$CCT_M$ is the combined correlated colour temperature of the LED lighting system;

$CCT_W$ is the correlated colour temperature of the warm-white LED source;

$CCT_C$ is the correlated colour temperature of the cool-white LED source;

$\phi_W$ is the averaged luminous flux of the warm-white LED source; and $\phi_C$ is the averaged luminous flux of the cool-white LED source.

In one embodiment, the method comprises calculating the averaged luminous flux of one or more of the LED sources as a function of a duty cycle ratio of the respective LED source.

In one embodiment, the method comprises calculating the averaged luminous flux of one or more of the LED sources as a function of one or more constant parameters. In one embodiment, the method comprises deriving the one or more constant parameters from measurement.

In one embodiment, the method comprises calculating the correlated colour temperature of one or more of the LED sources as a function of a total duty cycle ratio of the respective LED source.

In one embodiment, the method comprises calculating the correlated colour temperature of one or more of the LED sources as a function of a minimum correlated colour temperature and a maximum correlated colour temperature of the respective LED source, the minimum and maximum correlated colour temperatures being calculated as functions of the total duty cycle ratio of the respective LED source.

In one embodiment, the method comprises calculating the correlated colour temperature of one or more of the LED sources as a polynomial function of a total duty cycle ratio of the respective LED source.

In one embodiment, the method comprises calculating with a numerical solver in accordance with the non-linear relationship the duty cycle or amplitude of each supply current required to provide the desired combined correlated colour temperature at the desired luminous flux.

In one embodiment, the duty cycles or amplitudes of each supply current required in accordance with the non-linear relationship to provide respective combined correlated colour temperatures and combined luminous fluxes are contained in a look-up table, and the method comprises selecting from the look-up table the duty cycle or amplitude of each supply current required to provide the desired combined correlated colour temperature at the desired combined luminous flux.

In one embodiment, the method comprises fixing the amplitude of each supply current to a constant value.

In one embodiment, the method comprises generating an individual pulse width modulation signal for each supply current.

In one embodiment, the method comprises receiving a user-defined combined correlated colour temperature for the LED lighting system from a user and setting the desired combined correlated colour temperature based on the user-defined combined correlated colour temperature. In one embodiment, if the user-defined combined correlated colour temperature is above a maximum combined correlated colour temperature for the LED lighting system then the desired combined correlated colour temperature is set to equal the maximum combined correlated colour temperature; if the user-defined combined correlated colour temperature is below a minimum combined correlated colour temperature for the LED lighting system then the desired combined correlated colour temperature is set to equal the minimum combined correlated colour temperature; and if the user-defined combined correlated colour temperature is less than or equal to the maximum combined correlated colour temperature, or is greater than or equal to the minimum combined correlated colour temperature, then the desired combined correlated colour temperature is set to equal the user-defined combined correlated colour temperature.

In one embodiment, the method comprises measuring the combined correlated colour temperature, and if the difference between the combined correlated colour temperature and the desired combined correlated colour temperature is larger than a predetermined correlated colour temperature tolerance then varying the duty cycle or amplitude of one or more supply currents such that the difference between the combined correlated colour temperature and the desired combined correlated colour temperature is less than or equal to the predetermined correlated colour temperature tolerance.

In one embodiment, the method comprises receiving a user-defined combined luminous flux for the LED lighting system from a user and setting the desired combined luminous flux for the LED lighting system. In one embodiment, if the user-defined combined luminous flux is above a maximum combined luminous flux for the LED lighting system then the desired combined luminous flux is set to equal the maximum combined luminous flux; if the user-defined combined luminous flux is below a minimum combined luminous flux for the LED lighting system then the desired combined luminous flux is set to equal the minimum combined luminous flux; and if the user-defined combined luminous flux is less than or equal to the maximum combined luminous flux, or is greater than or equal to the minimum combined luminous flux, then the desired combined luminous flux is set to equal the user-defined combined luminous flux.

In one embodiment, the method comprises measuring a junction temperature of the LED sources, and if the junction temperature is above a maximum rated junction temperature of the LED sources then reducing the desired combined luminous flux.

In one embodiment, the method comprises measuring the combined luminous flux, and if the difference between the combined luminous flux and the desired combined luminous flux is larger than a predetermined luminous flux tolerance then varying the duty cycle or amplitude of one or more supply currents such that the difference between the combined luminous flux and the desired combined luminous flux is less than or equal to the predetermined luminous flux tolerance.

A third aspect of the present invention provides a non-transitory computer-readable storage medium with an executable program stored thereon, wherein the program instructs a processor to perform a method as described above.

Further features of various embodiments of the present invention are defined in the appended claims. It will be appreciated that features may be combined in various combinations in various embodiments of the present invention.

Throughout this specification, including the claims, the words "comprise", "comprising", and other like terms are to be construed in an inclusive sense, that is, in the sense of "including, but not limited to", and not in an exclusive or exhaustive sense, unless explicitly stated otherwise or the context clearly requires otherwise.

BRIEF DESCRIPTION OF THE FIGURES

Preferred embodiments in accordance with the best mode of the present invention will now be described, by way of example only, with reference to the accompanying figures, in which:

FIG. 2(*b*) is a graph of experimental values of luminous flux of a warm-white LED when a cool-white LED in the same LED lamp is fully off with $D_C$=0 and fully on with $D_C$=1;

FIG. 6(*b*) is a graph of desired and measured values of the combined luminous flux and combined CCT of a bi-color white LED lamp controlled in accordance with an embodiment of the present invention;

DETAILED DESCRIPTION OF PREFERRED EMBODIMENTS OF THE INVENTION

Figure 1:
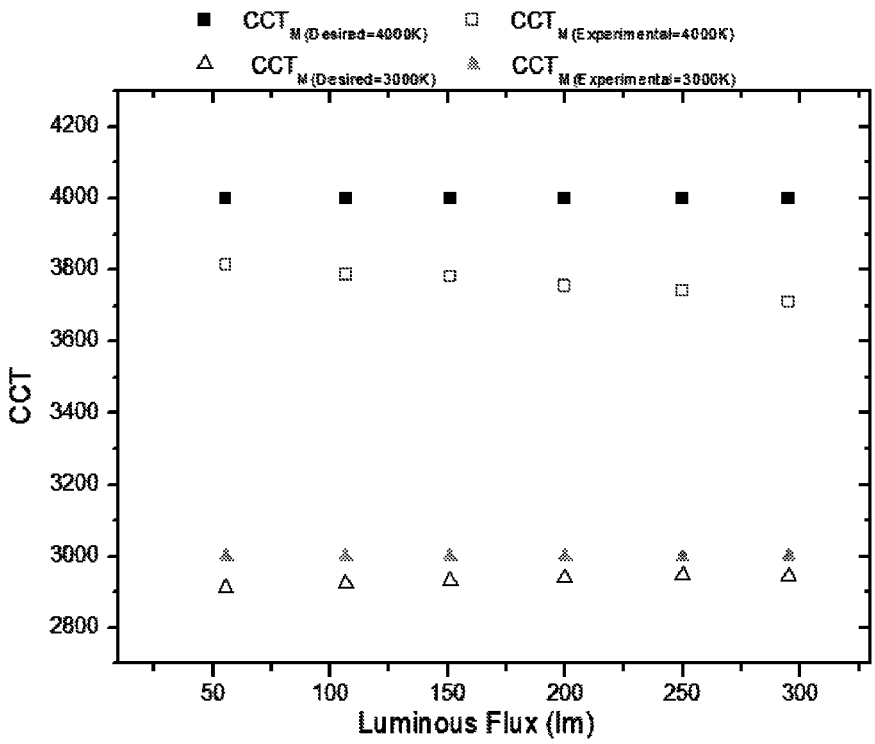
FIG. 1 is a graph of experimentally measured values of combined correlated colour temperatures $CCT_M$ for different combined luminous fluxes $\Phi_M$ for two CCT references of $CCT_{M(Desired)}$=3000 K and 4000 K in respect of a bi-colour LED lamp with a cool-white PC LED (Sharp GW5BNC15L02) and a warm-white PC LED (Sharp GW5BTF27K00) mounted on a heatsink with a thermal resistance of 6.3 K/W and driven by DC currents in accordance with prior art methods.

Referring to the figures, preferred embodiments of the present invention provide a correlated colour temperature control system 1 for a LED lighting system 2 having at least two LED sources 3 and 4 with different correlated colour temperatures. The LED lighting system has a combined correlated colour temperature resulting from the combination of the different correlated colour temperatures of the at least two LED sources. The LED lighting system also has a combined luminous flux resulting from the combination of the luminous fluxes of the at least two LED sources. Each LED source is supplied with a supply current. The correlated colour temperature control system comprises a controller 5 to independently control one or both of the duty cycle and amplitude of each supply current. The duty cycle or amplitude of each supply current is varied by the controller 5 in a non-linear relationship with the duty cycle or amplitude of at least one other of the supply currents to generate a desired combined correlated colour temperature for the LED lighting system at a desired combined luminous flux for the LED lighting system.

Throughout the present specification, the terms "combined", "mixed", "overall", and like terms are used to describe the correlated colour temperature (CCT), luminous flux, and other parameters of the LED lighting system as a whole Which result from the combination of respective parameters of the individual LED sources that form part of the LED lighting system. As well as "desired", the terms "set" and "tartlet" are also used in the present specification to indicate the desired setpoint for a system parameter.

The non-linear relationship takes into account thermal effects of each LED on the combined correlated colour temperature of the LED lighting system 2. In some embodiments, the non-linear relationship takes into account one or more of the following characteristics of one or more of the LED sources: the correlated colour temperature, luminous flux, junction temperature, and the thermal effect of the other LED sources.

Usually, the LED sources are mounted on one or more heatsinks. In these cases, the non-linear relationship takes into account a thermal resistance of one or more of the heatsinks.

Generally, the non-linear relationship is defined by the following equation:

$$CCT_M = \frac{\phi_1 + \ldots + \phi_n}{\frac{\phi_1}{CCT_1} + \ldots + \frac{\phi_n}{CCT_n}}$$

in which:

$CCT_M$ is the combined correlated colour temperature of the LED lighting system;

$CCT_1$ is the correlated colour temperature of the 1st LED source;

$CCT_n$ is the correlated colour temperature of the nth. LED source;

$\phi_1$ is the averaged luminous flux of the 1st LED source; and $\phi_n$ is the averaged luminous flux of the nth LED source.

In one embodiment, the LED lighting system 2 has a warm-white LED source 3 and a cool-white LED source 4. In this case, the non-linear relationship is defined by the following equation:

$$CCT_M = \frac{\phi_W + \phi_C}{\frac{\phi_W}{CCT_W} + \frac{\phi_C}{CCT_C}}$$

in which:

$CCT_M$ is the combined correlated colour temperature of the LED lighting system;

$CCT_W$ is the correlated colour temperature of the warm-white LED source;

$CCT_C$ is the correlated colour temperature of the cool-white LED source;

$\phi_W$ is the averaged luminous flux of the warm-white LED source; and $\phi_C$ is the averaged luminous flux of the cool-white LED source.

The averaged luminous flux of one or more of the LED sources is a function of a duty cycle ratio of the respective LED source. The averaged luminous flux of one or more of the sources is also a function of one Or more constant parameters. The one or more constant parameters are derived from measurement. More detailed embodiments of these relationships will be described hereinbelow.

The correlated colour temperature of one or more of the LED sources is a function of a total duty cycle ratio of the respective LED source.

In one embodiment, the correlated colour temperature of one or more of the LED sources is a function of a minimum correlated colour temperature and a maximum correlated colour temperature of the respective LED source, the minimum and maximum correlated colour temperatures being functions of the total duty cycle ratio of the respective LED source. In another embodiment, the correlated colour temperature of one or more of the LED sources is a polynomial function of a total duty cycle ratio of the respective LED source.

In one embodiment, the controller comprises a numerical solver to determine in accordance with the non-linear relationship the duty cycle or amplitude of each supply current required to provide the desired combined correlated colour temperature at the desired combined luminous flux.

In another embodiment, the duty cycles or amplitudes of each supply current required in accordance with the nonlinear relationship to provide respective combined correlated colour temperatures and combined luminous fluxes are contained in a look-up table. In this embodiment, the controller 5 selects from the look-up table the duty cycle or amplitude of each supply current required to provide the desired combined correlated colour temperature at the desired combined luminous flux.

In some embodiments, the amplitude of each supply current is fixed. Accordingly, the duty cycles of the supply currents are varied to provide the desired combined correlated colour temperature at the desired combined luminous flux.

Figure 5:
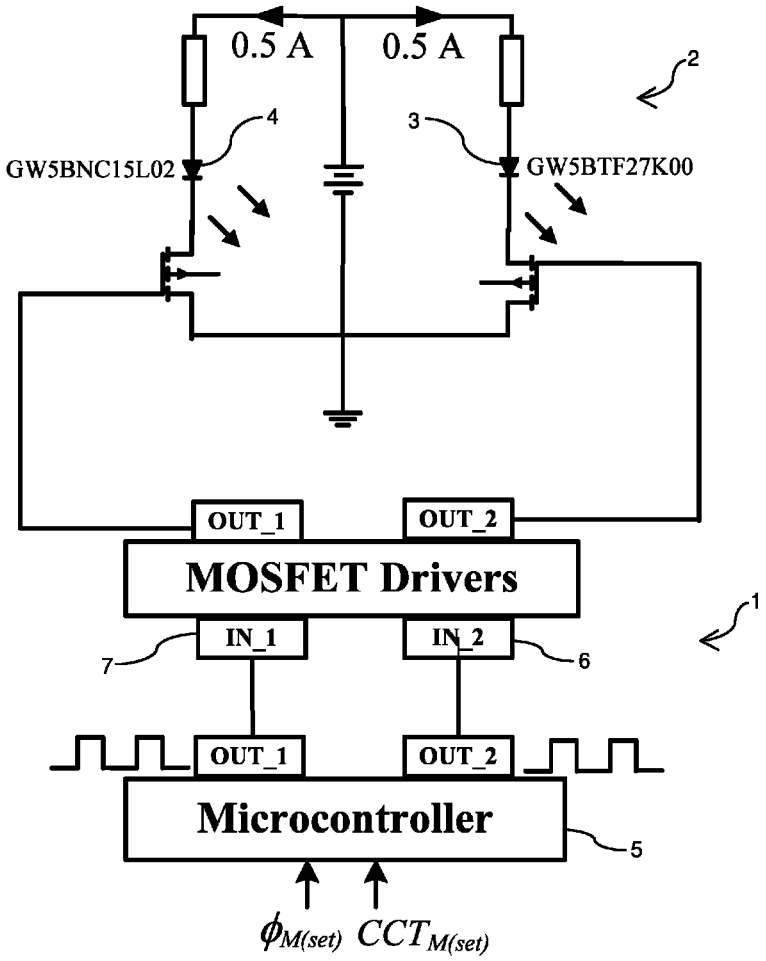
FIG. 5 is a schematic diagram of a correlated colour temperature control system in accordance with an embodiment of the present invention.

In one embodiment, the controller 5 generates an individual pulse width modulation signal for each supply current. In one specific implementation, as best shown in FIG. 5, the correlated colour temperature control system 1 comprises a MOSFET driver 6 and 7 for each supply current. Each MOSFET driver 6 and 7 receives a respective pulse width modulation signal and modulates the respective supply current in accordance with the respective pulse width modulation signal. More particularly, each MOSFET driver 6 and 7 comprises MOSFET switches to modulate the supply current.

Figure 7:
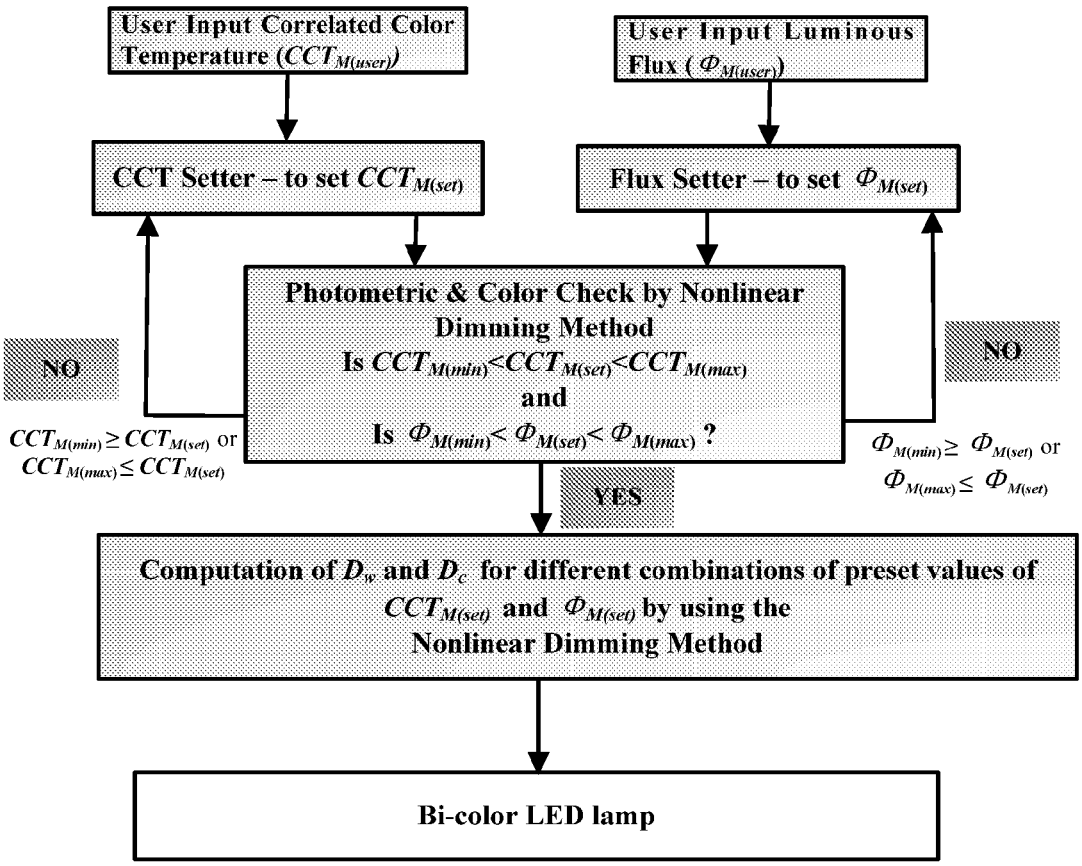
FIG. 7 is a flowchart of a method in accordance with an embodiment of the present invention.
Figure 9:
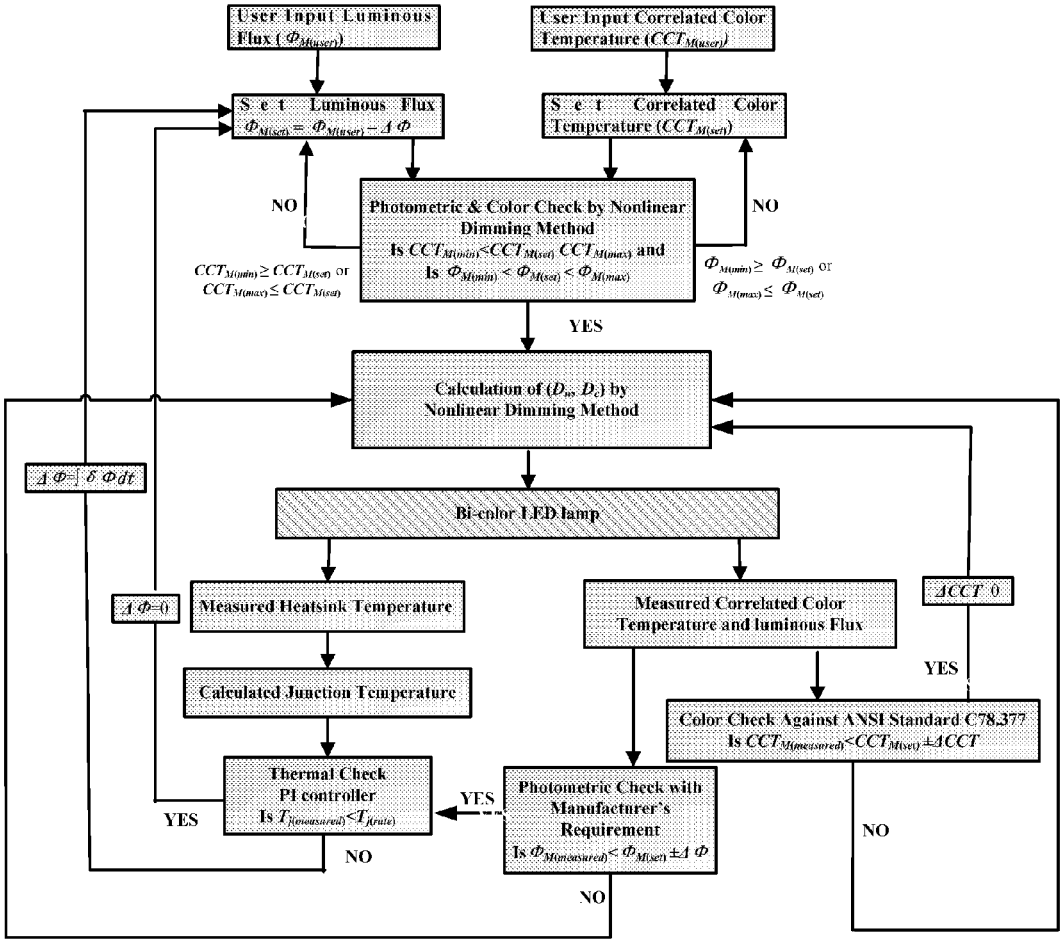
FIG. 9 is a flowchart of a method in accordance with another embodiment of the present invention.

As best shown in FIGS. 7 and 9, one embodiment of the correlated colour temperature control system 1 comprises a combined correlated colour temperature setting module (CCT Setter) for receiving a user-defined combined correlated colour temperature for the LED lighting system from a user and setting the desired combined correlated colour temperature based on the user-defined combined correlated colour temperature.

If the user-defined combined correlated colour temperature is above a maximum combined correlated colour temperature for the LED lighting system then the desired combined correlated colour temperature is set to equal the maximum combined correlated colour temperature. If the user-defined combined correlated colour temperature is below a minimum combined correlated colour temperature for the LED lighting system then the desired combined correlated colour temperature is set to equal the minimum combined correlated colour temperature. If, however, the user-defined combined correlated colour temperature is less than or equal to the maximum combined correlated colour temperature, or is greater than or equal to the minimum combined correlated colour temperature, then the desired combined correlated colour temperature is set to equal the user-defined combined correlated colour temperature.

The correlated colour temperature control system can also have feedback features built into it. As best shown in FIG. 9, the correlated colour temperature control system 1 comprises a light sensor to measure the combined correlated colour temperature, and if the difference between the combined correlated colour temperature and the desired combined correlated colour temperature is larger than a predetermined correlated colour temperature tolerance then the controller 5 varies the duty cycle or amplitude of one or more supply currents such that the difference between the combined correlated colour temperature and the desired combined correlated colour temperature is less than or equal to the predetermined correlated colour temperature tolerance.

Also as best shown in FIGS. 7 and 9, the correlated colour temperature control system 1 can comprise a combined luminous flux setting module (Flux Setter) for receiving a user-defined combined luminous flux for the LED lighting system from a user and setting the desired combined luminous flux for the LED lighting system. The Flux Setter can be used alone or in combination with the CCT Setter.

If the user-defined combined luminous flux is above a maximum combined luminous flux for the LED lighting system then the desired combined luminous flux is set to equal the maximum combined luminous flux. If the user-defined combined luminous flux is below a minimum combined luminous flux for the LED lighting system then the desired combined luminous flux is set to equal the minimum combined luminous flux. If, however, the user-defined combined luminous flux is less than or equal to the maximum combined luminous flux, or is greater than or equal to the minimum combined luminous flux, then the desired combined luminous flux is set to equal the user-defined combined luminous flux.

As best shown in FIG. 9, the correlated colour temperature control system 1 can comprise a temperature sensor to measure a junction temperature of the LED sources, and if the junction temperature is above a maximum rated junction temperature of the LED sources then the desired combined luminous flux is reduced. The correlated colour temperature control system can also comprise a photometric sensor to measure the combined luminous flux, and if the difference between the combined luminous flux and the desired combined luminous flux is larger than a predetermined luminous flux tolerance then the controller varies the duty cycle or amplitude of one or more supply currents such that the difference between the combined luminous flux and the desired combined luminous flux is less than or equal to the predetermined luminous flux tolerance.

The correlated colour temperature control system 1 described above can be in the form of a module that can be added to an existing LED lighting system. The correlated colour temperature control system 1 described above can also be in the form of part of an LED lighting system whether or not the correlated colour temperature control system 1 is an integrated or removable part of the LED lighting system.

The present invention also provides a method of controlling a correlated colour temperature of a LED lighting system having at least two LED sources with different correlated colour temperatures. A preferred embodiment is a method of controlling a correlated colour temperature of the LED lighting system 2, which has the at least two LED sources 3 and 4 with different correlated colour temperatures. As described above, the LED lighting system 1 has a combined correlated colour temperature resulting from the combination of the different correlated colour temperatures of the at least two LED sources 3 and 4, and a combined luminous flux resulting from the combination of the luminous fluxes of the at least two LED sources 3 and 4, with each LED source being supplied with a supply current. The preferred embodiment of the method comprises independently controlling one or both of the duty cycle and amplitude of each supply current by varying the duty cycle or amplitude of each supply current in a non-linear relationship with the duty cycle or amplitude of at least one other of the supply currents to generate a desired combined correlated colour temperature for the LED lighting system at a desired combined luminous flux for the LED lighting system.

The method comprises taking into account thermal effects of each LED on the combined correlated colour temperature of the LED lighting system 2 when varying the duty cycle or amplitude of each supply current. In some embodiments, the method comprises taking into account one or more of the following characteristics of one or more of the LED sources: the correlated colour temperature, luminous flux, junction temperature, and the thermal effect of the other LED sources, when varying the duty cycle or amplitude of each supply current.

In cases where the LED sources are mounted on one or more heatsinks, the method comprises taking into account a thermal resistance of one or more of the heatsinks when varying the duty cycle or amplitude of each supply current.

Generally, the method comprises calculating the non-linear relationship with the following equation:

$$CCT_M = \frac{\phi_1 + \ldots + \phi_n}{\frac{\phi_1}{CCT_1} + \ldots + \frac{\phi_n}{CCT_n}}$$

in which:

$CCT_M$ is the combined correlated colour temperature of the LED lighting system;

$CCT_1$ is the correlated colour temperature of the 1st LED source;

$CCT_1$ is the correlated colour temperature of the nth LED source;

$\phi_1$ is the averaged luminous flux of the 1st LED source; and $\phi_n$ is the averaged luminous flux of the nth LED source.

In one embodiment, the LED lighting system 2 has a warm-white LED source 3 and a cool-white LED source 4. In this case, the method comprises calculating the non-linear relationship with the following equation:

$$CCT_M = \frac{\phi_W + \phi_C}{\frac{\phi_W}{CCT_W} + \frac{\phi_C}{CCT_C}}$$

in which:

$CCT_M$ is the combined correlated colour temperature of the LED lighting system;

$CCT_W$ is the correlated colour temperature of the warm-white LED source;

$CCT_C$ is the correlated colour temperature of the cool-white LED source;

$\phi_W$ is the averaged luminous flux of the warm-white LED source; and $\phi_C$ is the averaged luminous flux of the cool-white LED source.

The method comprises calculating the averaged luminous flux of one or more of the LED sources as a function of a duty cycle ratio of the respective LED source. The method comprises calculating the averaged luminous flux of one or more of the LED sources as a function of one or more constant parameters as well. The method also comprises deriving the one or more constant parameters from measurement. More detailed embodiments of these relationships will be described hereinbelow.

The method comprises calculating the correlated colour temperature of one or more of the LED sources as a function of a total duty cycle ratio of the respective LED source.

In one embodiment, the method comprises calculating the correlated colour temperature of one or more of the LED sources as a function of a minimum correlated colour temperature and a maximum correlated colour temperature of the respective LED source, the minimum and maximum correlated colour temperatures being calculated as functions of the total duty cycle ratio of the respective LED source. In another embodiment, the method comprises calculating the correlated colour temperature of one or more of the LED sources as a polynomial function of a total duty cycle ratio of the respective LED source.

In one embodiment, the method comprises calculating with a numerical solver in accordance with the non-linear relationship the duty cycle or amplitude of each supply current required to provide the desired combined correlated colour temperature at the desired luminous flux.

In another embodiment, the duty cycles or amplitudes of each supply current required in accordance with the non-linear relationship to provide respective combined correlated colour temperatures and combined luminous fluxes are contained in a look-up table, and the method comprises selecting from the look-up table the duty cycle or amplitude of each supply current required to provide the desired combined correlated colour temperature at the desired combined luminous flux.

In some embodiments, the method comprises fixing the amplitude of each supply current to a constant value. Accordingly, the method comprises varying the duty cycles of the supply currents to provide the desired combined correlated colour temperature at the desired combined luminous flux.

In one embodiment, the method comprises generating an individual pulse width modulation signal for each supply current. In one specific implementation, as described above, MOSFET drivers 6 and 7 are used to receive respective pulse width modulation signals and modulate respective supply currents in accordance with the respective pulse width modulation signals.

In one embodiment, the method comprises receiving a user-defined combined correlated colour temperature for the LED lighting system from a user and setting the desired combined correlated colour temperature based on the user-defined combined correlated colour temperature.

If the user-defined combined correlated colour temperature is above a maximum combined correlated colour temperature for the LED lighting system then the desired combined correlated colour temperature is set to equal the maximum combined correlated colour temperature. If the user-defined combined correlated colour temperature is below a minimum combined correlated colour temperature for the LED lighting system then the desired combined correlated colour temperature is set to equal the minimum combined correlated colour temperature. If, however, the user-defined combined correlated colour temperature is less than or equal to the maximum combined correlated colour temperature, or is greater than or equal to the minimum combined correlated colour temperature, then the desired combined correlated colour temperature is set to equal the user-defined combined correlated colour temperature.

In one embodiment, the method comprises measuring the combined correlated colour temperature, and if the difference between the combined correlated colour temperature and the desired combined correlated colour temperature is larger than a predetermined correlated colour temperature tolerance then varying the duty cycle or amplitude of one or more supply currents such that the difference between the combined correlated colour temperature and the desired combined correlated colour temperature is less than or equal to the predetermined correlated colour temperature tolerance.

In one embodiment, the method comprises receiving a user-defined combined luminous flux for the LED lighting system from a user and setting the desired combined luminous flux for the LED lighting system.

If the user-defined combined luminous flux is above a maximum combined luminous flux for the LED lighting system then the desired combined luminous flux is set to equal the maximum combined luminous flux. If the user-defined combined luminous flux is below a minimum combined luminous flux for the LED lighting system then the desired combined luminous flux is set to equal the minimum combined luminous flux. If, however, the user-defined combined luminous flux is less than or equal to the maximum combined luminous flux, or is greater than or equal to the minimum combined luminous flux, then the desired combined luminous flux is set to equal the user-defined combined luminous flux.

In one embodiment, the method comprises measuring a junction temperature of the LED sources, and if the junction temperature is above a maximum rated junction temperature of the LED sources then reducing the desired combined luminous flux. The method can also comprise measuring the combined luminous flux, and if the difference between the combined luminous flux and the desired combined luminous flux is larger than a predetermined luminous flux tolerance then varying the duty cycle or amplitude of one or more supply currents such that the difference between the combined luminous flux and the desired combined luminous flux is less than or equal to the predetermined luminous flux tolerance.

The present invention also provides a non-transitory computer-readable storage medium with an executable program stored thereon, wherein the program instructs a processor to perform a method of controlling a correlated colour temperature of a LED lighting system, such as the embodiments of the methods described above. The non-transitory computer-readable storage medium includes, but is not limited to, portable memory modules, such as flash memory chips, memory modules included with controller circuits for LED lighting systems, and memory modules accessible by servers through which the executable program can be downloaded by a user.

A more detailed technical description of an embodiment in which the LED lighting system 1 has two LED sources with different respective CCTs will now be presented. In particular, the LED lighting system is a bi-colour white LED lamp with a cool-white LED source of 5000 K and a warm-white LED source of 2700 K. It must be emphasized that this particular embodiment is only one embodiment, described for illustrative purposes only, and that the present invention is not limited to the features of this particular embodiment. The present invention applies to LED lighting systems having more than two sources and sources that are not white.

(1) Nonlinear COT function of Bi-Color Variable COT White LED Systems $$CCT_M = \frac{\phi_W + \phi_C}{\frac{\phi_W}{CCT_W} + \frac{\phi_C}{CCT_C}} \quad \text{(Equation 3)}$$

Equation 3 represents a non-linear function of the mixed $CCT_M$ (correlated color temperature of total light emitted from the hi-color LED lamp) linking luminous flux and CCT of individual LED sources together with that of the mixed light. Here, $\phi_W$ and $CCT_W$ are respectively the averaged luminous flux and COT value of the warm-white LED source and $\phi_C$ and $CCT_C$ are respectively the luminous flux and CCT value of the cool-white LED source. Unlike the linear approaches based on Equation (1) or (2) in which $CCT_W$ and $CCT_C$ are assumed constant, here $CCT_W$ and $CCT_C$ are functions of the operating conditions, i.e., current, junction temperature, and duty ratio D. This is important since in practice, the CCT of an LED source is highly dependent on its junction temperature and current amplitude.

(2) Empirical Luminous Model of the LEDs in the Bi-Color White LED Lamp

The junction temperature of an LED is affected by its current level, driving technique, heatsink size, and ambient temperature. For the hi-color white LED lamp, the junction temperature of the cool-white LED source is affected by the operating state of the warm-white LED source, and this is conversely true. Such a thermal interdependency effect is accounted for in the luminous and OCT models used in embodiments of the present invention.

(i) Experimental Measurement

Figure 2A:
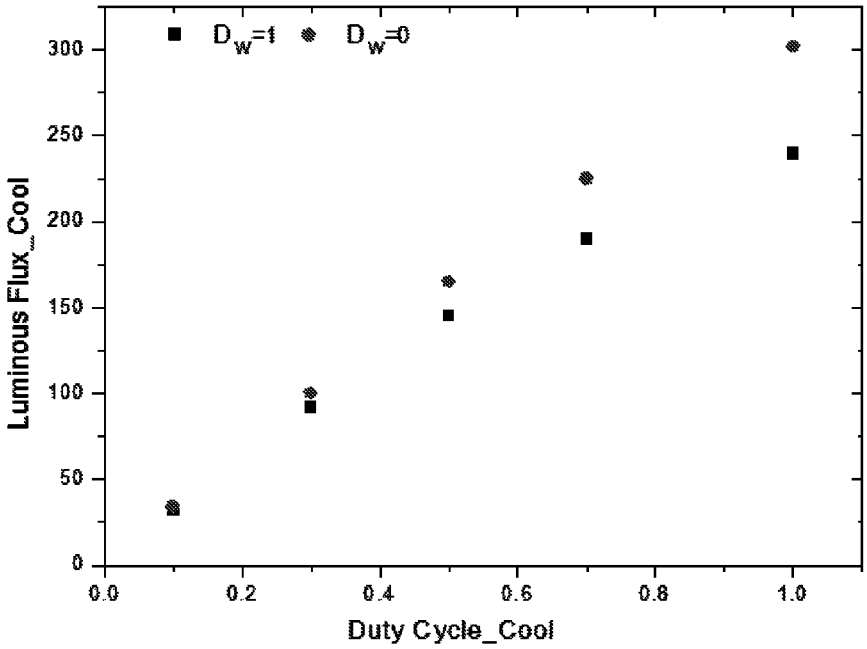
FIG. 2(*a*) is a graph of experimental values of luminous flux of a cool-white LED when a warm-white LED in the same LED lamp is fully off with $D_W$=0 and fully on with $D_W$=1.
Figure 2B:
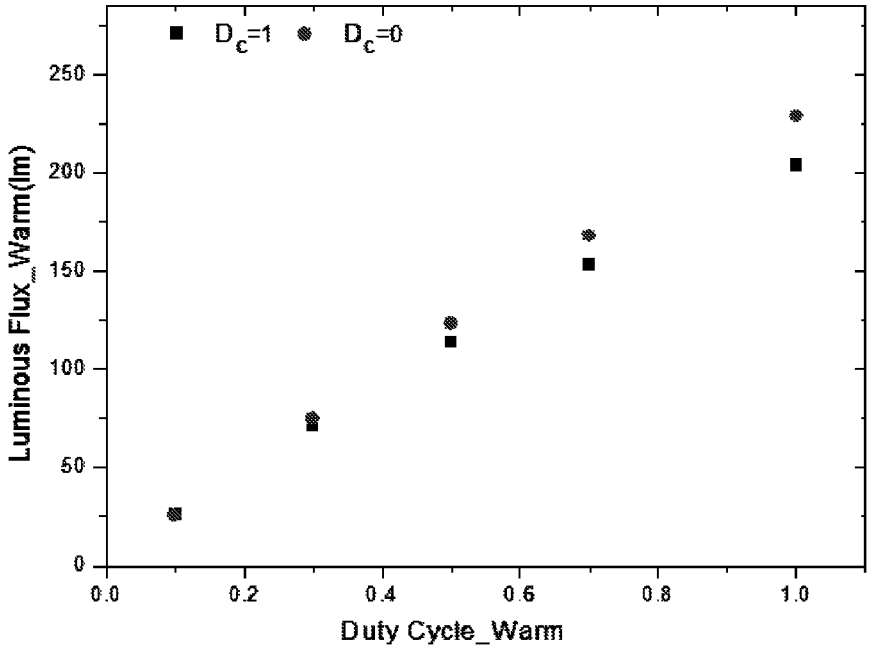

The mathematical luminous models are built upon results obtained from the LED sources through experimental measurements. The experimental work required both the cool-white and warm-white LED sources to be mounted on the same heatsink and turned on at the same. When the measurement was conducted on one LED source, the remaining LED source(s) were covered by black rubber which prevents its/their luminous flux from being emitted into space. FIG. 2(*a*) shows the luminous flux versus duty ratio $D_C$ of the cool-white LED in both conditions of $D_W=0$ and $D_W=1$ ($D_W$ is the duty ratio of the warm-white LED). FIG. 2(*b*) shows the luminous flux versus duty ratio $D_W$ of the warm-white LED in both conditions of $D_C=0$ (cool-white turned off) and $D_C=1$ (cool-white fully turned on).

(ii) Exponential Function Curve Fitting

With the experimental results obtained, the luminous flux characteristics were mathematically modeled. For this case, using FIG. 2(*a*), the cool-white LED was modeled in one embodiment as:

$$\phi_C=\phi_{C0}-\alpha_C e^{\beta_C D_C} \quad \text{(Equation 4a)}$$

where $\phi_C$ is luminous flux of cool-white LED, $\phi_{C0}$ and $\alpha_C$ are constant parameters derivable from measurement, and $\beta_C$ is a variable related to the duty cycle of warm-white LED, i.e., $D_W$. Likewise, the characteristics of the warm-white LED given in FIG. 2(*b*) were modeled in one embodiment as:

$$\phi_W=\phi_{W0}-\alpha_W e^{\beta_W D_W} \quad \text{(Equation 4b)}$$

By considering operating range of the warm-white LED to be $D_{W,min} \le D_W \le D_{W,max}$ and the cool-white LED to be $D_{C,min} \le D_C \le D_{C,max}$. Equations 4a and 4b can be re-Written as:

$$\phi_C(D_C, D_W) = \phi_{C0} - \alpha_C \exp\left\{\left[\frac{(\beta_{Cmax} - \beta_{Cmin})}{(D_{Wmax} - D_{Wmin})}(D_W - D_{Wmin}) + \beta_{Cmin}\right] D_C\right\} \quad \text{(Equation 5a)}$$

$$\phi_W(D_C, D_W) = \phi_{W0} - \alpha_W \exp\left\{\left[\frac{(\beta_{Wmax} - \beta W_{min})}{(D_{Cmax} - D_{Cmin})}(D_C - D_{Cmin}) + \beta_{Wmin}\right] D_W\right\} \quad \text{(Equation 5b)}$$

Equation 5a gives the luminous flux of the cool-white LED at any $D_C$ and $D_W$ value, of which $D_W$ contributes to the thermal energy affecting the junction temperature of the cool-white LED. Here, the gradient $\beta_C$ for any $D_W$ is obtained through the linear interpolation of $\beta_{C,max}$ and $\beta_{C,min}$, which is derivable from the results. Equation 5b is the counterpart equation for the warm-white LED.

(3) Empirical CCT Model of the LEDs in the Bi-Color White LED Lamp

Similar to the luminous model, the thermal interdependency effect of each LED source on the remaining source(s) was accounted for in the CCT model.

(i) Cool-White LED

With the warm-white LED covered by black rubber, the maximum and minimum CCT values of the cool-white LED (i.e., $CCT_{C,max}$ and $CCT_{C,min}$) were measured as a function of the total duty ratio $D_T$, where $0 \le D_T = D_C + D_W \le 2$. For any value of $D_T$, there are two combinations of $D_C$ and $D_W$ that will each result in a maximum and a minimum CCT value. To obtain the plot of maximum CCT against $D_T$, the following equation was considered:

$$(D_C, D_W)_{CCT_{C,max}} = \begin{cases} D_C = D_T, D_W = 0; & \text{if } D_T \le 1 \\ D_C = 1, D_W = D_T - 1; & \text{if } D_T > 1 \end{cases} \quad \text{(Equation 6a)}$$

To measure the minimum CCT plot against $D_T$, the following equation was considered:

$$(D_C, D_W)_{CCT_{C,min}} = \begin{cases} D_C = 0.1, D_W = D_T - 0.1; & \text{if } D_T \le 1 \\ D_C = D_T - 1, D_W = 1; & \text{if } D_T > 1 \end{cases} \quad \text{(Equation 6b)}$$

With the measured maximum and minimum CCT, the averaged CCT of the cool-white LED at any $D_T$ can be calculated using:

$$CCT_{C,ave(measured)}(D_T) = \frac{CCT_{C,max}(D_T) + CCT_{C,min}(D_T)}{2} \quad \text{(Equation 7)}$$

Figure 3:
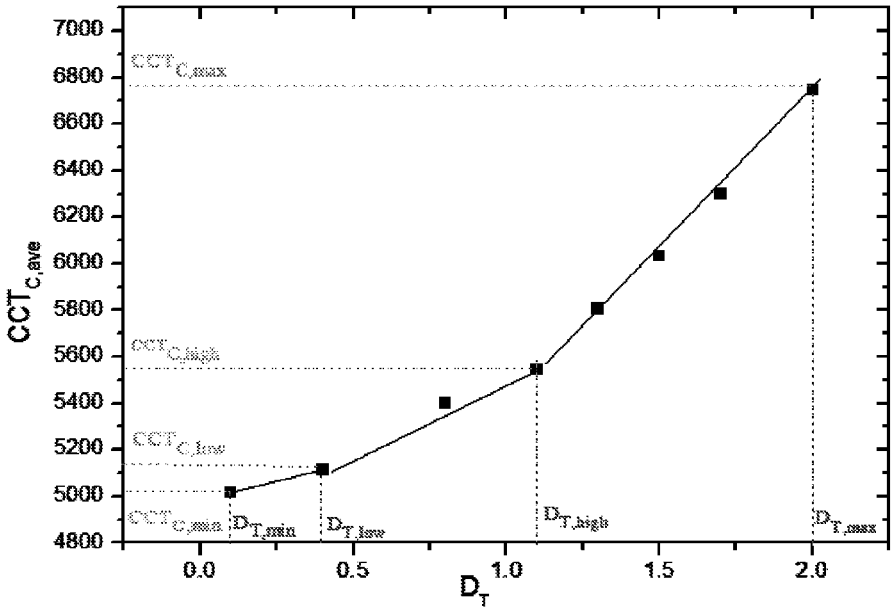
FIG. 3 is a graph of averaged CCT against $D_T$ of a cool-white LED with three straight lines fitted to the data shown in the graph.

FIG. 3 shows a plot of the averaged CCT that was calculated from the measured maximum and minimum CCT using Equation 7.

The averaged CCT of the cool-white LED can be modeled using piecewise linear solution as:

$$CCT_{C,ave(calculated)}(D_T) = \begin{cases} \frac{CCT_{C,low} - CCT_{C,min}}{D_{T,low} - D_{T,min}}(D_T - D_{T,min}) + CCT_{C,min} & \text{if } D_{T,min} \le D_T < D_{T,low} \\ \frac{CCT_{C,high} - CCT_{C,low}}{D_{T,high} - D_{T,low}}(D_T - D_{T,low}) + CCT_{C,low} & \text{if } D_{T,low} \le D_T < D_{T,high} \\ \vdots & \\ \frac{CCT_{C,max} - CCT_{C,high}}{D_{T,max} - D_{T,high}}(D_T - D_{T,high}) + CCT_{C,high} & \text{if } D_{T,high} \le D_T \le D_{T,max} \end{cases} \quad \text{(Equation 8)}$$

If a more accurate CCT model is desired, polynomial curve fitting can be used, which leads to a mathematical expression of this general form:

$$CCT_{C,ave(calculated)}(D_T) = \alpha D_T^2 + \beta D_T + \gamma \quad \text{(Equation 9)}$$

(ii) Warm-White LED

With the cool-white LED covered by black rubber, the maximum and minimum CCT values of the warm-white LED (i.e., $CCT_{W,max}$ and $CCT_{W,min}$) are measured. The following equations for setting the duty ratios of the cool-white and warm-white LEDs were considered:

$$(D_C, D_W)_{CCT_{W,max}} = \begin{cases} D_W = D_T, D_C = 0; & \text{if } D_T \le 1 \\ D_W = 1, D_C = D_T - 1; & \text{if } D_T > 1 \end{cases} \quad \text{(Equation 10a)}$$

$$(D_C, D_W)_{CCT_{W,min}} = \begin{cases} D_W - 0.1, D_C - D_T - 0.1; & \text{if } D_T \le 1 \\ D_W = D_T - 1, D_C = 1; & \text{if } D_T > 1 \end{cases} \quad \text{(Equation 10b)}$$

Then, the averaged CCT of the warm-white LED can be calculated from:

$$CCT_{W,ave(measured)}(D_T) = \frac{CCT_{W,max}(D_T) + CCT_{W,min}(D_T)}{2} \quad \text{(Equation 11)}$$

Figure 4:
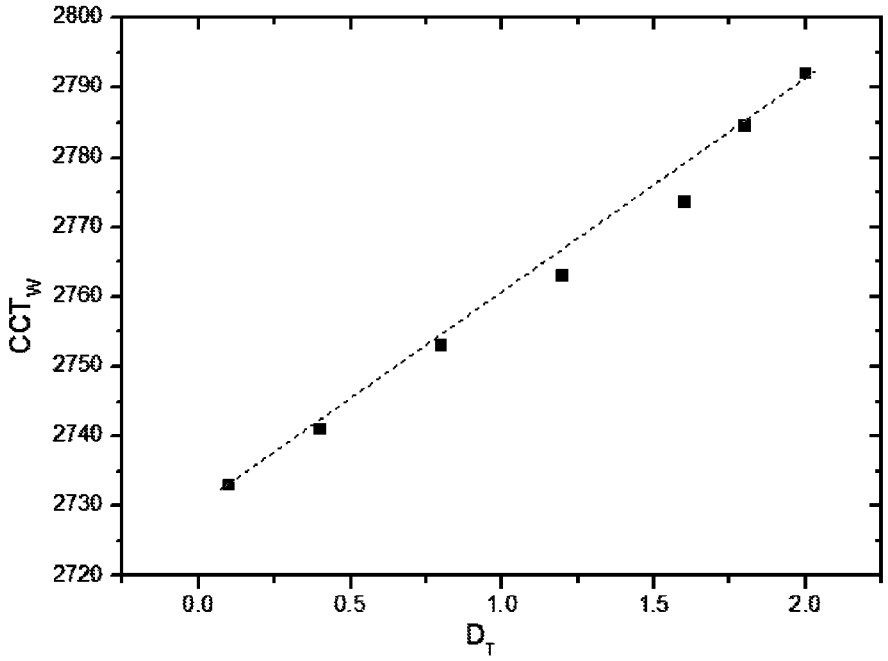
FIG. 4 is a graph of averaged CCT against $D_T$ of a warm-white LED with a single straight line fitted to the data shown in the graph.

FIG. 4 shows a graph of the averaged CCT of the warm-white LED that was calculated from the measured maximum and minimum CCT values. It can be modeled as:

$$CCT_{W,ave(calculated)}(D_T) = \frac{CCT_{W,max} - CCT_{W,min}}{D_{T,max} - D_{T,min}}(D_T - D_{T,min}) + CCT_{W,min} \quad \text{(Equation 12)}$$

(4) Complete Luminous and CCT Model of the Bi-Color White LED Source Lamp

The total luminous flux $\phi_M(D_C, D_W)$ of the tai-color LED system is the combined luminous flux of both the warm-white and the cool-white LED and by considering Equations 5a and 5b, the equation can be expressed as:

$$\psi_M(D_C, D_W) - \psi_C(D_C, D_W) + \psi_W(D_C, D_W) = \phi_{C0} - \alpha_C \exp\left\{\left[\frac{\beta_{C,max} - \beta_{C,min}}{D_{W,max} - D_{W,min}}(D_W - D_{W,min}) + \beta_{C,min}\right] D_C\right\} + \phi_{W0} - \alpha_W \exp\left\{\left[\frac{\beta_{W,max} - \beta_{W,min}}{D_{C,max} - D_{C,min}}(D_C - D_{C,min}) + \beta_{W,min}\right] D_W\right\} \quad \text{(Equation 13)}$$

Considering that the CCT of the cool-white LED and the warm-white LED are represented by Equations 8 and 12, the mixed for combined) $CCT_M$ of the bi-color LED system can be expressed as:

$CCT_M(D_T) =$ (Equation 14)

$$\begin{cases} \dfrac{\phi_{C0} - \alpha_C \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\} + \phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\dfrac{\phi_{C0} - \alpha_C \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\}}{\left\{\dfrac{CCT_{C,low} - CCT_{C,min}}{D_{T,low} - D_{T,min}}(D_T - D_{T,min}) + CCT_{C,min}\right\}} + \dfrac{\phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\left\{\dfrac{CCT_{W,max} - CCT_{W,min}}{D_{T,max} - D_{T,min}}(D_T - D_{T,min}) + CCT_{W,min}\right\}}} \\ \text{if } D_{T,min} \le D_T \le D_{T,low} \\ \dfrac{\phi_{C0} - \alpha_C \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\} + \phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\dfrac{\phi_{C0} - \alpha_C \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\}}{\left\{\dfrac{CCT_{C,high} - CCT_{C,low}}{D_{T,high} - D_{T,low}}(D_T - D_{T,low}) + CCT_{C,low}\right\}} + \dfrac{\phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\left\{\dfrac{CCT_{W,max} - CCT_{W,min}}{D_{T,max} - D_{T,min}}(D_T - D_{T,min}) + CCT_{W,min}\right\}}} \\ \text{if } D_{T,low} \le D_T \le D_{T,high} \\ \vdots \\ \dfrac{\phi_{C0} - \alpha_c \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\} + \phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\dfrac{\phi_{C0} - \alpha_c \exp\left\{\left[\left(\dfrac{\beta_{C,max} - \beta_{C,min}}{D_{W,max} - D_{W,min}}\right)(D_W - D_{W,min}) + \beta_{C,min}\right] D_C\right\}}{\left\{\dfrac{CCT_{C,max} - CCT_{C,high}}{D_{T,max} - D_{T,high}}(D_T - D_{T,high}) + CCT_{C,high}\right\}} + \dfrac{\phi_{W0} - \alpha_W \exp\left\{\left[\left(\dfrac{\beta_{W,max} - \beta_{W,min}}{D_{C,max} - D_{C,min}}\right)(D_C - D_{C,min}) + \beta_{W,min}\right] D_W\right\}}{\left\{\dfrac{CCT_{W,max} - CCT_{W,min}}{D_{T,max} - D_{T,min}}(D_T - D_{T,min}) + CCT_{W,min}\right\}}} \\ \text{if } D_{T,high} \le D_T \le D_{T,max} \end{cases}$$

(5) Experimental Results (i) Experimental Setup

FIG. 5 shows the basic diagram of the experimental circuit. With the desired combined flux $\phi_M$(set) and the desired combined correlated color temperature $CCT_{M(set)}$ being input into the circuit, the microcontroller (e.g. STC 11F60XE-351-PLCC44), which includes a software-based numerical solver, generates two individual PWM signals feeding the MOSFET switches through the MOSFET drivers (e.g. MC33512) for dimming the cool-white LED (e.g. GW5BNC15L02) and the warm-white LED (e.g. GW5BTF27K00) in order to perform the necessary control in accordance with embodiments of the present invention. The current amplitude of the cool-white and warm-white LEDs are set precisely at 0.5 A and 0.5 A. Both the LEDs are mounted on the same heatsink which has a thermal resistance of 6.3 K/W. The combined light of both LED sources in terms of the overall (or combined) $\phi_M$ and $CCT_M$ are measured using a spectro-photocolorimeter (e.g. PMS-50).

(ii) Numerical Solver

A software-based numerical solver generates the required duty ratios $D_C$ and $D_W$ for the bi-color lamp to produce the required combined CCT and combined luminous flux according to the input values of the desired combined luminous flux $\phi_{M(set)}$ and the desired combined correlated colour temperature $CCT_{M(set)}$.

(iii) Experimental Results and Discussion

The approach according to embodiments of the present invention and a prior linear approach are compared for particular desired setpoints of combined luminous flux (i.e. $\phi_{M(set)}$=50 lm; 100 lm; 150 lm; 200 lm; 250 lm; and 300 lm) and combined CCT (i.e. $CCT_{M(set)}$=3000 K; 3500 K; 4000 K; 4500 K; and 5000 K). In all, there are 30 possible combinations of target setpoints.

Figure 6A:
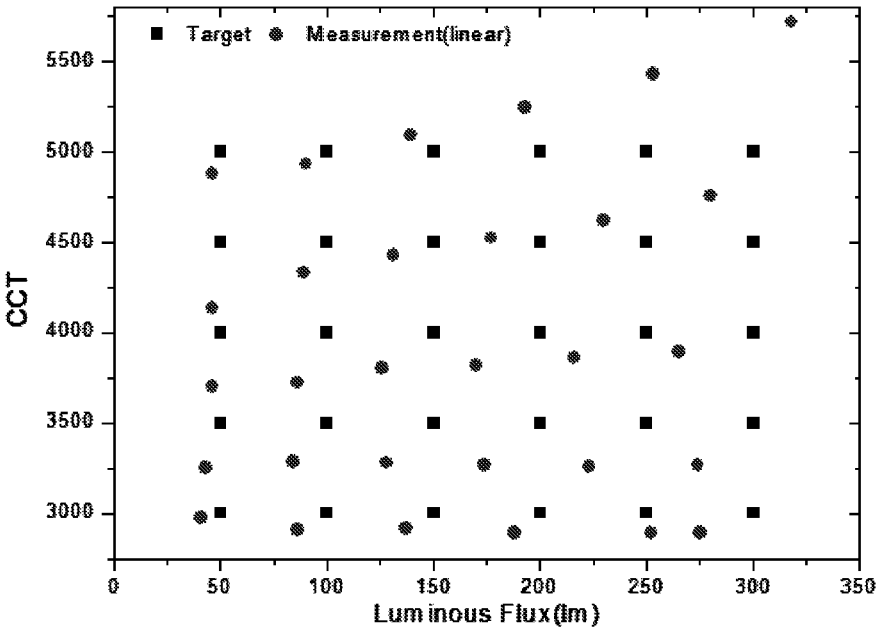
FIG. 6(*a*) is a graph of desired and measured values of the combined luminous flux and combined CCT of a bi-color white LED lamp controlled in accordance with prior art methods.
Figure 6B:
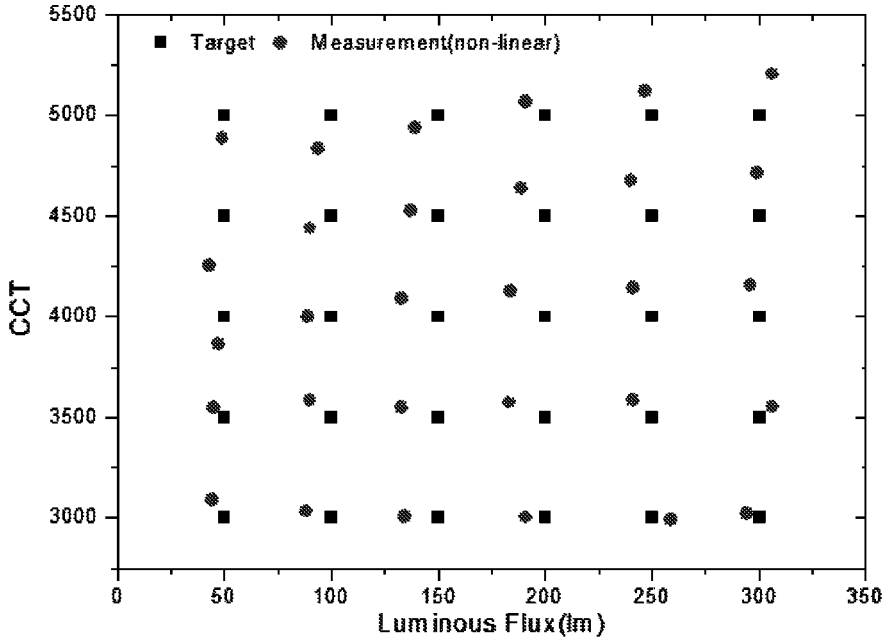

FIGS. 6(*a*) and 6(*b*) depict the experimentally measured values of the combined luminous flux and combined CCT of the bi-color white LED lamp obtained with a prior linear approach and the non-linear approach provided by embodiments of the present invention, respectively. It is clear that the non-linear approach in accordance with embodiments of the present invention results in significantly more accurate flux and CCT control of the bi-color variable LED lighting system. In FIGS. 6(*a*) and 6(*b*), the desired combined CCT and desired combined luminous flux are referred to as "Target" and indicated as squares on the graphs. The actual or measured combined CCT and actual or measured combined luminous flux are referred to as "Measurement" and indicated as circles on the graphs.

(6) Operational Flow

FIG. 7 shows a flowchart of an embodiment of a method in accordance with the present invention for independently controlling the color temperature and light intensity of a bi-color LED lamp ("open-loop method"). A set of user-defined setpoints for the luminous flux $\Phi_{M(user)}$ and correlated color temperature $CCT_{M(user)}$ must first be input into the system. The control system then assumes the user-defined setpoints as the actual desired setpoints $\Phi_{M(set)}$ and $CCT_{M(set)}$ for the system through Flux Setter and CCT Setter, respectively. Since colour and flux of the LED system change non-linearly with the electrical power and junction temperature, their controllable ranges are dependent on the electrical power, the thermal resistance of the devices, and the heatsink used. It is necessary that the desired setpoints must be chosen to be within the controlled ranges that are predetermined by the non-linear dimming method in accordance with embodiments of the present invention. In use, they must fall within the calculated flux range of $\Phi_{M(min)} < \Phi_{M(set)} < \Phi_{M(max)}$ and the calculated CCT range of $CCT_{M(min)} < CCT_{M(set)} < CCT_{M(max)}$. Otherwise, adjustment of the desired setpoints $\Phi_{M(set)}$ and $CCT_{M(set)}$ to within these limits will be performed by the Flux Setter and CCT Setter.

Once the values of the desired setpoints $\Phi_{M(set)}$ and $CCT_{M(set)}$ are within the required limits, they are passed to the non-linear dimming method in accordance with embodiments of the present invention to solve for the required values of $D_W$ and $D_C$ for respectively controlling the warm-white LEDs and the cool-white LEDs to achieve the desired combined light intensity (combined luminous flux) and combined CCT of the bi-color LED lamp. The computation of $D_W$ and $D_C$ using the non-linear dimming method in accordance with embodiments of the present invention can be achieved through the following methods:

(a) real-time computation of the non-linear equations given in Equations 13 and 14 or their variation through analog or digital means, such as FPGA, microprocessor, IC et al.; or (b) a look-up table with pre-saved values of $D_W$ and $D_C$ for different combinations of desired $CCT_{M(set)}$ and $\Phi_{M(set)}$ in accordance with embodiments of the method of the present invention.

Figure 8:
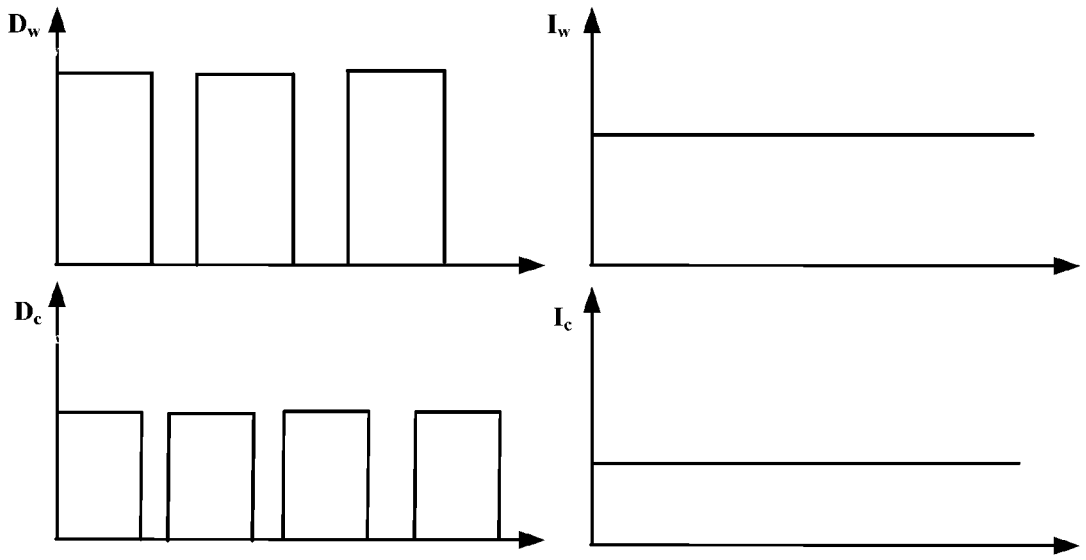
FIG. 8 depicts graphs of forms of $D_W$ and $D_C$ generated by a system in accordance with an embodiment of the present invention.

FIG. 8 shows the two possible forms of $D_W$ and $D_C$ generated by the non-linear dimming method according to embodiments of the present invention. In the case of bi-color lamps where the LEDs are associated with pulse width modulation (PWM) type drivers, dimming is performed directly with the PWM signals of $D_W$ and $D_C$ as shown on the left side of FIG. 8. For bi-color lamps where the LEDs are associated with amplitude modulation (AM) type drivers, the current reference of the warm-white LEDs and the cool-white LEDs will be the averaged form of $D_W$ and $D_C$ and are given by $I_W$ and $I_C$, respectively, as shown on the right side of FIG. 8.

FIG. 9 shows a flowchart of an embodiment of a method in accordance with the present invention with temperature, $CCT_n$ and luminous flux feedback control for independently controlling the combined correlated color temperature and combined light intensity (combined luminous flux) of a bi-color LED lamp based on the user-defined input $\Phi_{M(user)}$ and $CCT_{M(user)}$ ("closed-loop method"). The desired setpoints are set as $\Phi_{M(set)}=\Phi_{M(user)}-\Delta\Phi$ (initial value of $\Delta\Phi$ is 0) and $CCT_{M(set)}=CCT_{M(user)}$. Similar to the open-loop method described in FIG. 7 and above, the desired setpoints here must be chosen to be within the controlled flux range of $\Phi_{M(min)}<\Phi_{M(set)}<\Phi_{M(max)}$ and CCT range of $CCT_{M(min)}<CCT_{M(set)}<CCT_{M(max)}$. Otherwise, the desired setpoints $\Phi_{M(set)}$ and $CCT_{M(set)}$ will be adjusted to within the limits. Then, the non-linear relationship in accordance with embodiments of the present invention is used to solve for the required values of $D_W$ and $D_C$, which are then fed into the bi-color LED lamp to control its combined light intensity (combined luminous flux) and combined CCT.

In this embodiment which includes feedback temperature control, the heatsink temperature is instantaneously measured either directly by a temperature sensor mounted on the heatsink or indirectly through other computational means, and is fed into the control loop. With the heatsink temperature, the measured junction temperature of the LEDs can be calculated using known thermal models of the system. The junction temperature is then checked against the rated junction temperature of the LEDs. If the junction temperature exceeds the allowable maximum temperature, the desired combined luminous flux is downwardly adjusted to reduce the electrical power of the LED. If the junction temperature is below or equal to the rated value, there is no change in the desired setpoint of the combined luminous flux.

It is known that correlated color temperature and luminous flux can be represented by the CIE 1931 tristimulus values X, Y and Z. To employ these parameters in the present embodiment, a light sensor with a spectral response that matches the CIE 1931 colour matching functions is required. A high degree of colour and luminous flux accuracy of the bi-color LED lamp is possible with the inclusion of this light sensor if the junction temperature of the LEDs is accurately known. In this embodiment, the measured CCT of the lamp $CCT_{M(measured)}$ is compared with the desired value $CCT_{M(set)}$ and their difference is checked against ANSI Standard C78.377. If the difference is larger than the acceptable tolerance specified in ANSI Standard C78.377, the value will be fed into the non-linear relationship according to embodiments of the present invention described above to adjust the duty cycles of the bi-color LED lamp such that the deviation between $CCT_{M(measured)}$ and $CCT_{M(set)}$ is within the acceptable tolerance.

A photometric check is also included in the present embodiment to ensure that the measured combined luminous flux is within the acceptable tolerance specified by the manufacturer. Here, the measured combined luminous flux $\Phi_{M(measured)}$ is compared with the desired combined luminous flux $\Phi_{M(set)}$ and their difference is checked against the acceptable tolerance. If the difference is larger than the acceptable tolerance, the value will be fed into the non-linear relationship according to embodiments of the present invention described above to adjust the duty cycles of the bi-color LED lamp such that the deviation between $\Phi_{M(measured)}$ and $\Phi_{M(set)}$ is within the acceptable tolerance.

(7) Colorimetry

According to colorimetry, the relationship between the tristimulus values (X,Y,Z) and chromaticity (x,y,z) of a light source can be written as:

$$\begin{cases} x = \dfrac{X}{X+Y+Z} \\ y = \dfrac{Y}{X+Y+Z} \\ z = \dfrac{Z}{X+Y+Z} \end{cases} \quad \text{(Equation C1)}$$

Equation C1 can be rewritten as:

$$\frac{X}{x} = \frac{Y}{y} = \frac{Z}{z} = X+Y+Z \quad \text{(Equation C2)}$$

or $$\begin{cases} X = \dfrac{x}{y}Y \\ Z = \dfrac{z}{y}Y = \dfrac{1-x-y}{y}Y \end{cases} \quad \text{(Equation C3)}$$

The tristimulus values for the RGB LED lamp is $(X_W, Y_W, Z_W)$ and for the cool-white LED source is $(X_C, Y_C, Z_C)$. The overall tristimulus values of the light emitted from the RGB LED lamp, which is the sum of the respective sources, is:

(Equation C4)

$$\begin{cases} X_M = X_R + X_G + X_B \\ Y_M = Y_R + Y_G + Y_B \\ Z_M = Z_R + Z_G + Z_B \end{cases}$$

(Equation C5)

$$\begin{aligned} x_M &= \frac{X_M}{X_M + Y_M + Z_M} = \frac{X_R + X_G + X_B}{X_R + X_G + X_B + Y_R + Y_G + Y_B + Z_R + Z_G + Z_B} \\ &= \frac{\frac{x_R}{y_R}Y_R + \frac{x_G}{y_G}Y_G + \frac{x_B}{y_B}Y_B}{\frac{x_R}{y_R}Y_R + \frac{x_G}{y_G}Y_G + \frac{x_B}{y_B}Y_B + Y_R + Y_G + Y_B + \frac{1 - x_R - y_R}{y_R}Y_R + \frac{1 - x_G - y_G}{y_G}Y_G + + \frac{1 - x_B - y_B}{y_B}Y_B} \\ &= \frac{\frac{x_R}{y_R}Y_R + \frac{x_G}{y_G}Y_G + \frac{x_B}{y_B}Y_B}{\frac{Y_R}{y_R} + \frac{Y_G}{y_G} + \frac{Y_B}{y_B}} \end{aligned}$$

(Equation C6)

$$\begin{aligned} y_M &= \frac{Y_M}{X_M + Y_M + Z_M} = \frac{Y_R + Y_G + Y_B}{X_R + X_G + X_B + Y_R + Y_G + Y_B + Z_R + Z_G + Z_B} \\ &= \frac{Y_R + Y_G + Y_B}{\frac{x_R}{y_R}Y_R + \frac{x_G}{y_G}Y_G + \frac{x_B}{y_B}Y_B + Y_R + Y_G + Y_B + \frac{1 - x_R - y_R}{y_R}Y_R + \frac{1 - x_G - y_G}{y_G}Y_G + + \frac{1 - x_B - y_B}{y_B}Y_B} \\ &= \frac{Y_R + Y_G + Y_B}{\frac{Y_R}{y_R} + \frac{Y_G}{y_G} + \frac{Y_B}{y_B}} \end{aligned}$$

Since the tristimulus value Y represents luminance, which is a proportional to the luminous flux $\Phi_v$, Equations C5 and C6 can be rewritten as:

(Equation C7)

$$x_M = \frac{\frac{x_R}{y_R}\phi_R + \frac{x_G}{y_G}\phi_G + \frac{x_B}{y_B}\phi_B}{\frac{\phi_R}{y_R} + \frac{\phi_G}{y_G} + \frac{\phi_B}{y_B}}$$

(Equation C8)

$$y_M = \frac{\phi_R + \phi_G + \phi_B}{\frac{\phi_R}{y_R} + \frac{\phi_G}{y_G} + \frac{\phi_B}{y_B}}$$

In both of the above expressions, the control of the colour and flux of the RGB LED lamp can be expressed as:

(Equation C9)

$$\begin{cases} x_M = \dfrac{\frac{x_R}{y_R}\phi_R + \frac{x_G}{y_G}\phi_G + \frac{x_B}{y_B}\phi_B}{\frac{\phi_R}{y_R} + \frac{\phi_G}{y_G} + \frac{\phi_B}{y_B}} \\ y_M = \dfrac{\phi_R + \phi_G + \phi_B}{\frac{\phi_R}{y_R} + \frac{\phi_G}{y_G} + \frac{\phi_B}{y_B}} \\ \phi_M = \phi_R + \phi_G + \phi_B \end{cases}$$

Figure 10:
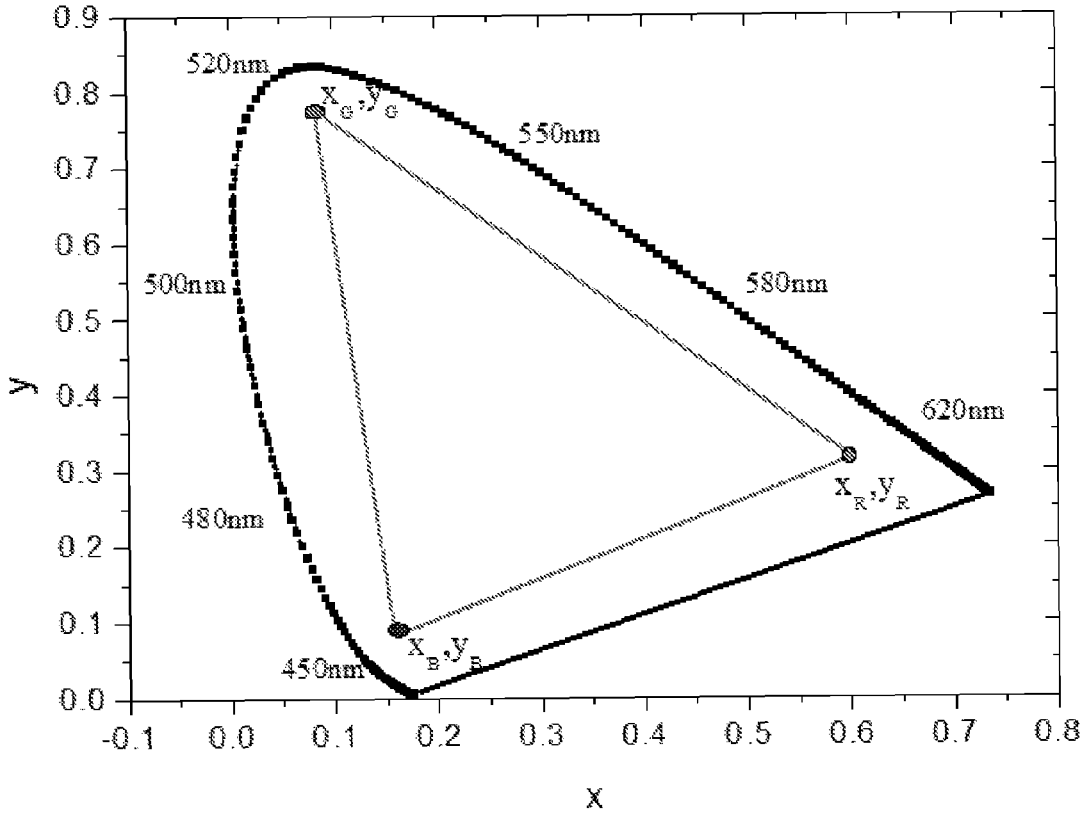
FIG. 10 is a graph showing the controlled colour region for mixing RGB colours with chromaticity coordinates ($x_R$, $y_R$), ($x_G$, $y_G$), ($x_B$, $y_B$)

The chromaticity coordinates of the mixed light (or combined light) is a combination of the individual chromaticity coordinates ($x_R$,$x_G$,$x_B$) weighted by the luminous flux ($\Phi_R$, $\Phi_G$, $\Phi_B$) factors. The principle of RGB color mixing in the chromaticity diagram is shown in FIG. 10. FIG. 10 shows the mixing of the RGB colors with chromaticity coordinates ($x_R$, $y_R$), ($x_G$, $y_G$), ($x_B$, $y_B$). The three chromaticity points are connected by lines. The area located within the lines represents all colours that can be created by mixing the three RGB colors.

Figure 11:
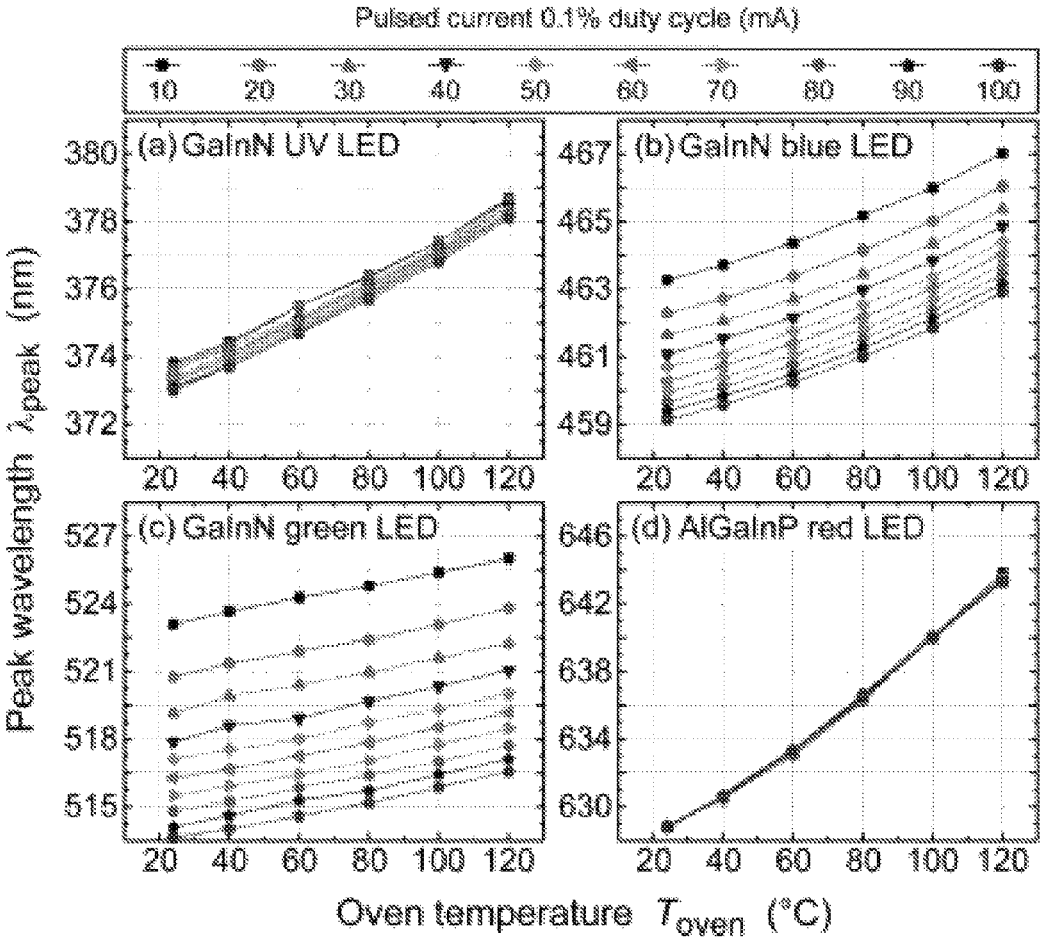
FIG. 11 depicts graphs showing the peak wavelengths for RGB sources versus temperature.

The ability to create a great variety of colors is an important quality for displays. It is noted that the three chromaticity points ($x_R$, $y_R$), ($x_G$, $y_G$), ($x_B$, $y_B$) shall shift with electrical power and junction temperature, due to the peak wavelength of RGB LED variation with junction temperature, as shown in FIG. 11. It is desirable that the controlled colour region provided by the RGB sources is as large as possible to create displays/lamps able to show varied hue. The controlled colour region represents the entire range of controlled colours that can be created from a set of RGB sources. The controlled colour region is a polygon positioned within the boundary of the chromaticity diagram.

Prior systems and methods for controlling combined CCT and combined luminous flux of mixed LED lighting systems did not cover the effect of current and temperature change on the colour properties of the LED sources. It was assumed that the reference CCT for the warm and the cool sources, respectively $CCT_{low}$ and $CCT_{high}$, are constants and are independent of the current level and junction temperature. Hence, the effect of such factors in the control of light intensity and CCT has not been taken into consideration in prior control systems and methods. The control of CCT in prior systems and methods has been performed through the linear adjustment of a weightage factor W or the duty cycle D based on prior Equations 1 and 2, respectively.

Prior systems and methods also did not take into consideration the relationship between the luminous flux, colour, current, temperature, and duty cycle of the light mixture of the lamp. In these prior systems and methods, the CCT of the light mixture from the lamp comprising low and high CCT LED sources were predicted using a simple linear average function of the light generated by the cool LED source and the light generated by the warm LED source. This kind of prediction is inaccurate in the case of light dimming over wide ranges and CCT control in which the temperature variation, and thus the temperature-dependent CCT variations, are significant.

With two or more LED sources within a lamp sharing the same heatsink and driven together, but individually controlled, there will be the thermal influence of one LED source on the CCT properties of the other LED sources. Prior systems and methods neglected such an effect of mutual thermal interdependency on the CCT of each LED source in their approaches.

By contrast, in the systems and methods of embodiments of the present invention, the CCT and luminous flux of the light mixture emitted from, for example, a white LED lamp made up of warm and cool LED sources are independently controlled by adjusting the duty cycles and/or the current levels of the LEDs. The LEDs are driven using a non-complementary driving approach, which does not mandate that the two LED arrays must be alternately driven. Moreover, according to embodiments of the present invention, the control of the dimming and CCT of the light mixture from the two LED arrays is based on the non-linear relationship of the luminous flux, colour, current, temperature, duty cycle, and mutual thermal interdepency effect, of the light mixture of the lamp.

It can be appreciated that the aforesaid embodiments are only exemplary embodiments adopted to describe the principles of the present invention, and the present invention is not merely limited thereto. Various variants and modifications may be made by those of ordinary skill in the art without departing from the spirit and essence of the present invention, and these variants and modifications are also covered within the scope of the present invention. Accordingly, although the invention has been described with reference to specific examples, it can be appreciated by those skilled in the art that the invention can be embodied in many other forms. It can also be appreciated by those skilled in the art that the features of the various examples described can be combined in other combinations.

REFERENCES

[1] American National Standard, Specifications for Chromaticity of Solid State Lighting Products, ANSI C78.377 (American National Standards Institute, 2008).

[2] C.-H. Miao, "Color temperature adjustable lamp," U.S. Pat. No. 8,159,125B2.

[3] K. Jonsson, "Light with changeable color temperature," US20120146505A1.

[4] J. Garcia, M. A. Dalla-Costa, J. Cardesin, J. M. Alonso, and M. Rico-Secades, "Dimming of high-brightness LEDs by means of luminous flux thermal estimation," IEEE Trans. Power Electron., vol. 24, no. 4, pp. 1107-1114, April 2009.

[5] M. Dyble, N. Narendran, A. Bierman, and T. Klein, "Impact of dimming white LEDs: Chromaticity shifts due to different dimming methods," Proc. SPIE, vol. 5941 pp. 291-299, 2005.

[6] S. Buso, G. Spiazzi, M. Meneghini, and G. Meneghesso, "Performance degradation of high-brightness light emitting diodes under DC and pulsed bias," IEEE Trans. Device Mater. Rel., vol. 8, no. 2, pp. 312-322, June 2008.

[7] S. C. Tan, "General n-level driving approach for improving electrical-to-optical energy-conversion efficiency of fast-response saturable lighting devices," IEEE Trans. Industral. Electron., vol. 57, no. 4, pp. 1342-1353, April 2010.

[8] R. Paschotta, Encyclopedia of Laser Physics and Technology. Wiley-VCH, pp. 219, 2008.

[9] O. Noboru. Colorimetry: fundamentals and applications, John Wiley & Sons, 2006.

[10] Y. Gu, N. Narendran, T. Dong, and H. Wu, "Spectral and luminous efficacy change of high-power LEDs under different dimming methods," Proceedings of SPIE., 2006.

[11] P. Manninen and P. Orreveteläinen, "On spectral and thermal behaviors of AlGaInP light-emitting diodes under pulse-width modulation," Appl. Phys. Lett., vol. 91, no. 18, pp. 181121-181123, 2007.

[12] M. Leroux, N. Grandjean, M. Laugt et al., "Quantum confined Stark effect due to built-in internal polarization fields in (Al,Ga)N/GaN quantum wells," Physical Review B, vol. 58, no. 20, pp. R13371-R13374, 1998.

[13] H. K. Fu, C. W. Lin, T. T. Chen, C. L. Chen, P. T. Chou, and C. J. Sun, "Investigation of dynamic color deviation mechanisms of high power light-emitting diode," Microelectronics Reliability, vol. 52, pp. 866-871, 2012.

The invention claimed is:

1. A correlated colour temperature control system for a LED lighting system having at least two LED sources with different correlated colour temperatures, the LED lighting system having a combined correlated colour temperature resulting from the combination of the different correlated colour temperatures of the at least two LED sources, the LED lighting system having a combined luminous flux resulting from the combination of the luminous fluxes of the at least two LED sources, each LED source being supplied with a supply current, the correlated colour temperature control system comprising a controller to independently control one or both of the duty cycle and amplitude of each supply current, the duty cycle or amplitude of each supply current being varied by the controller in a non-linear relationship with the duty cycle or amplitude of at least one other of the supply currents, to generate a desired combined correlated colour temperature for the LED lighting system at a desired combined luminous flux for the LED lighting system.

2. A correlated colour temperature control system according to claim 1 wherein the non-linear relationship takes into account thermal effects of each LED on the combined correlated colour temperature of the LED lighting system.

3. A correlated colour temperature control system according to any one of claim 1 wherein the non-linear relationship takes into account one or more of the following characteristics of one or more of the LED sources: the correlated colour temperature, luminous flux, junction temperature, and the thermal effect of the other LED sources.

4. A correlated colour temperature control system according to claim 1 wherein the LED sources are mounted on one or more heatsinks, and the non-linear relationship takes into account a thermal resistance of one or more of the heatsinks.

5. A correlated colour temperature control system according to claim 1 wherein the non-linear relationship is defined by the following equation:

$$CCT_M = \frac{\phi_1 + \ldots + \phi_n}{\frac{\phi_1}{CCT_1} + \ldots + \frac{\phi_n}{CCT_n}}$$

in which:

$CCT_M$ is the combined correlated colour temperature of the LED lighting system;

$CCT_1$ is the correlated colour temperature of the 1st LED source;

$CCT_n$ is the correlated colour temperature of the nth LED source;

$\phi_1$ is the averaged luminous flux of the 1st LED source; and $\phi_n$ is the averaged luminous flux of the nth LED source.

6. A correlated colour temperature control system according to claim 1 wherein the controller comprises a numerical solver to determine in accordance with the non-linear relationship the duty cycle or amplitude of each supply current required to provide the desired combined correlated colour temperature at the desired combined luminous flux.

7. A correlated colour temperature control system according to claim 1 wherein the duty cycles or amplitudes of each supply current required in accordance with the non-linear relationship to provide respective combined correlated colour temperatures and combined luminous fluxes are contained in a look-up table, and the controller selects from the look-up table the duty cycle or amplitude of each supply current required to provide the desired combined correlated colour temperature at the desired combined luminous flux.

8. A correlated colour temperature control system according to claim 1 wherein the amplitude of each supply current is fixed.

9. A correlated colour temperature control system according to claim 1 wherein the controller generates an individual pulse width modulation signal for each supply current.

10. A correlated colour temperature control system according to claim 9 comprising a MOSFET driver for each supply current, the MOSFET driver receiving the pulse width modulation signal and modulating the supply current in accordance with the pulse width modulation signal.

11. A correlated colour temperature control system according to claim 10 wherein each MOSFET driver comprises MOSFET switches to modulate the supply current.

12. A correlated colour temperature control system according to claim 1 comprising a combined correlated colour temperature setting module for receiving a user-defined combined correlated colour temperature for the LED lighting system from a user and setting the desired combined correlated colour temperature based on the user-defined combined correlated colour temperature.

13. A correlated colour temperature control system according to claim 12 wherein:

if the user-defined combined correlated colour temperature is above a maximum combined correlated colour temperature for the LED lighting system then the desired combined correlated colour temperature is set to equal the maximum combined correlated colour temperature;

if the user-defined combined correlated colour temperature is below a minimum combined correlated colour temperature for the LED lighting system then the desired combined correlated colour temperature is set to equal the minimum combined correlated colour temperature; and if the user-defined combined correlated colour temperature is less than or equal to the maximum combined correlated colour temperature, or is greater than or equal to the minimum combined correlated colour temperature, then the desired combined correlated colour temperature is set to equal the user-defined combined correlated colour temperature.

14. A correlated colour temperature control system according to claim 1 comprising a light sensor to measure the combined correlated colour temperature, and if the difference between the combined correlated colour temperature and the desired combined correlated colour temperature is larger than a predetermined correlated colour temperature tolerance then the controller varies the duty cycle or amplitude of one or more supply currents such that the difference between the combined correlated colour temperature and the desired combined correlated colour temperature is less than or equal to the predetermined correlated colour temperature tolerance.

15. A correlated colour temperature control system according to claim 1 comprising a combined luminous flux setting module for receiving a user-defined combined luminous flux for the LED lighting system from a user and setting the desired combined luminous flux for the LED lighting system.

16. A correlated colour temperature control system according to claim 15 wherein:

if the user-defined combined luminous flux is above a maximum combined luminous flux for the LED lighting system then the desired combined luminous flux is set to equal the maximum combined luminous flux;

if the user-defined combined luminous flux is below a minimum combined luminous flux for the LED lighting system then the desired combined luminous flux is set to equal the minimum combined luminous flux; and if the user-defined combined luminous flux is less than or equal to the maximum combined luminous flux, or is greater than or equal to the minimum combined luminous flux, then the desired combined luminous flux is set to equal the user-defined combined luminous flux.

17. A correlated colour temperature control system according to claim 1 comprising a temperature sensor to measure a junction temperature of the LED sources, and if the junction temperature is above a maximum rated junction temperature of the LED sources then the desired combined luminous flux is reduced.

18. A correlated colour temperature control system according to claim 1 comprising a photometric sensor to measure the combined luminous flux, and if the difference between the combined luminous flux and the desired combined luminous flux is larger than a predetermined luminous flux tolerance then the controller varies the duty cycle or amplitude of one or more supply currents such that the difference between the combined luminous flux and the desired combined luminous flux is less than or equal to the predetermined luminous flux tolerance.

19. A method of controlling a correlated colour temperature of a LED lighting system having at least two LED sources with different correlated colour temperatures, the LED lighting system having a combined correlated colour temperature resulting from the combination of the different correlated colour temperatures of the at least two LED sources, the LED lighting system having a combined luminous flux resulting from the combination of the luminous fluxes of the at least two LED sources, each LED source being supplied with a supply current, the method comprising independently controlling one or both of the duty cycle and amplitude of each supply current by varying the duty cycle or amplitude of each supply current in a non-linear relationship with the duty cycle or amplitude of at least one other of the supply currents to generate a desired combined correlated colour temperature for the LED lighting system at a desired combined luminous flux for the LED lighting system.

20. A non-transitory computer-readable storage medium with an executable program stored thereon, wherein the program instructs a processor to perform a method in accordance with claim 19.

* * * * *